US010151433B2

(12) United States Patent
McLennan et al.

(10) Patent No.: US 10,151,433 B2
(45) **Date of Patent: *Dec. 11, 2018**

(54) PORTABLE LIGHT HAVING A MOLDED HOUSING AND/OR A DUAL FUNCTION LIGHT SOURCE

(71) Applicant: Streamlight, Inc., Eagleville, PA (US)

(72) Inventors: W. Ross McLennan, Perkasie, PA (US); Matthew B. Dalton, Elkins Park, PA (US)

(73) Assignee: Streamlight, Inc., Eagleville, PA (US)

( * ) Notice: Subject to any disclaimer, the term of this patent is extended or adjusted under 35 U.S.C. 154(b) by 259 days.

This patent is subject to a terminal disclaimer.

(21) Appl. No.: 15/154,528

(22) Filed: May 13, 2016

(65) Prior Publication Data

US 2016/0252222 A1 Sep. 1, 2016

Related U.S. Application Data

(62) Division of application No. 14/959,512, filed on Dec. 4, 2015, now Pat. No. 9,347,656, which is a division (Continued)

(51) Int. Cl.
*F21L 4/08* (2006.01)
*F21L 4/04* (2006.01)

(Continued)

(52) U.S. Cl.
CPC ..... *F21L 4/085* (2013.01); *F21L 4/027* (2013.01); *F21L 4/04* (2013.01); *F21L 4/045* (2013.01);

(Continued)

(58) Field of Classification Search
CPC ..... F21L 4/04; F21L 4/08; F21L 4/027; F21L 4/045; F21L 4/085; F21V 21/32;

(Continued)

(56) References Cited

U.S. PATENT DOCUMENTS

D139,628 S 12/1944 Chapman
2,467,954 A 4/1949 Becker (Continued)

FOREIGN PATENT DOCUMENTS

CN 202442126 9/2012
JP 2007-500933 1/2007

(Continued)

OTHER PUBLICATIONS

European Patent Office, "Supplementary European Search Report", EP Patent Application No. 14872204.4, dated Jul. 18, 2017, 7 pages.

(Continued)

*Primary Examiner* — Stephen F Husar
(74) *Attorney, Agent, or Firm* — Clement A. Berard, Esq.; Dann, Dorfman, Herrell & Skillman, PC

(57) ABSTRACT

A portable light may comprise a light housing having a USB connector tray integrally molded therewith; a light source; a switch for selectively actuating the light source; and a circuit board in the light housing providing electrical contacts of a USB connector, whereby the connector tray and the electrical contacts cooperate to define a USB connector. The light source may operate in a mode wherein it provides illumination light and in a different mode wherein it provides an indication of charging.

20 Claims, 6 Drawing Sheets

Related U.S. Application Data of application No. 14/135,803, filed on Dec. 20, 2013, now Pat. No. 9,206,951.

(51) Int. Cl.

| | |
|---|---|
| ***F21V 21/088*** | (2006.01) |
| ***F21V 23/04*** | (2006.01) |
| ***F21V 21/32*** | (2006.01) |
| ***F21L 4/02*** | (2006.01) |
| ***F21V 23/00*** | (2015.01) |
| ***F21V 23/06*** | (2006.01) |
| *F21Y 115/10* | (2016.01) |

(52) U.S. Cl.

CPC ..... *F21L 4/08* (2013.01); *F21V 21/0885* (2013.01); *F21V 21/32* (2013.01); *F21V 23/008* (2013.01); *F21V 23/0414* (2013.01); *F21V 23/06* (2013.01); *F21Y 2115/10* (2016.08)

(58) Field of Classification Search

CPC .... F21V 21/0885; F21V 23/008; F21V 23/06; F21V 23/0414; F21Y 2115/10

See application file for complete search history.

(56) References Cited

U.S. PATENT DOCUMENTS

| | | | |
|---|---|---|---|
| 2,539,974 | A | 1/1951 | Riddell |
| D166,073 | S | 3/1952 | Dunkelberger |
| 2,612,598 | A | 9/1952 | Berman |
| 2,648,762 | A | 8/1953 | Dunkelberger |
| 2,949,612 | A | 8/1960 | Kafko et al. |
| 3,103,723 | A | 9/1963 | Becker |
| 3,111,277 | A | 11/1963 | Grimsley |
| 3,881,468 | A | 5/1975 | Foltz |
| 4,092,580 | A | 5/1978 | Prinsze |
| D268,442 | S | 3/1983 | Darmon |
| 4,406,040 | A | 9/1983 | Cannone |
| RE31,458 | E | 12/1983 | Trattner |
| 4,495,550 | A | 1/1985 | Visciano |
| D281,820 | S | 12/1985 | Oba et al. |
| D283,645 | S | 4/1986 | Tanaka |
| D296,827 | S | 7/1988 | Yuen |
| D302,325 | S | 7/1989 | Charet et al. |
| D306,212 | S | 2/1990 | Holterscheidt |
| 5,050,053 | A | 9/1991 | McDermott |
| D328,144 | S | 7/1992 | Yuen |
| 5,154,483 | A | 10/1992 | Zeller |
| D332,839 | S | 1/1993 | Beckner, Jr. |
| 5,197,796 | A | 3/1993 | Moore |
| D341,220 | S | 11/1993 | Eagan |
| D344,358 | S | 2/1994 | Yuen |
| D349,776 | S | 8/1994 | Yuen |
| 5,369,556 | A | 11/1994 | Zeller |
| 5,410,457 | A | 4/1995 | Parker |
| 5,432,689 | A | 7/1995 | Sharrah |
| D362,313 | S | 9/1995 | Zeller |
| D364,935 | S | 12/1995 | deBlois |
| 5,486,432 | A | 1/1996 | Sharrah |
| D374,734 | S | 10/1996 | Esposito |
| 5,571,279 | A | 11/1996 | Chiang |
| D377,989 | S | 2/1997 | Marvin et al. |
| D378,858 | S | 4/1997 | Kaiser |
| 5,615,945 | A | 4/1997 | Tseng |
| D379,540 | S | 5/1997 | Szymanski |
| D379,541 | S | 5/1997 | Kaiser |
| D379,542 | S | 5/1997 | Egashira |
| 5,633,574 | A | 5/1997 | Sage |
| D380,061 | S | 6/1997 | Swyst |
| D380,844 | S | 7/1997 | Kaiser |
| D381,101 | S | 7/1997 | Haberstich et al. |
| D381,445 | S | 7/1997 | Linnane |
| D381,446 | S | 7/1997 | Kaiser |
| D381,447 | S | 7/1997 | Haberstich et al. |
| D382,075 | S | 8/1997 | Swyst |
| D383,231 | S | 9/1997 | Kaiser |
| D385,637 | S | 10/1997 | Rombough |
| D387,454 | S | 12/1997 | Kaiser |
| 5,707,137 | A | 1/1998 | Hon |
| D390,985 | S | 2/1998 | Shiau |
| 5,716,121 | A | 2/1998 | Dubois |
| 5,717,276 | A | 2/1998 | Hsu |
| D392,758 | S | 3/1998 | Cedarberg, III |
| D394,721 | S | 5/1998 | Santarsiero |
| D403,453 | S | 12/1998 | Shiau |
| D413,993 | S | 9/1999 | Yuen |
| 5,975,712 | A | 11/1999 | Shiao |
| D418,235 | S | 12/1999 | Houplain |
| D418,240 | S | 12/1999 | Sherman |
| 6,000,809 | A | 12/1999 | Belo |
| 6,004,004 | A | 12/1999 | Altman et al. |
| 6,007,214 | A | 12/1999 | Shiao |
| 6,022,119 | A | 2/2000 | Booty, Jr. |
| 6,046,572 | A | 4/2000 | Matthews et al. |
| D425,642 | S | 5/2000 | Zeller |
| 6,104,162 | A | 8/2000 | Sainsbury |
| 6,142,644 | A | 11/2000 | Leung |
| D435,679 | S | 12/2000 | Naghi et al. |
| 6,213,618 | B1 | 4/2001 | Dobbin et al. |
| 6,280,050 | B1 | 8/2001 | Bird et al. |
| 6,469,619 | B1 | 10/2002 | Mayercheck et al. |
| 6,471,064 | B2 | 10/2002 | Gordon |
| 6,569,555 | B1 | 5/2003 | Faris |
| D479,888 | S | 9/2003 | Sharrah et al. |
| 6,621,225 | B2 | 9/2003 | Bruwer |
| 6,633,152 | B2 | 10/2003 | Sharrah |
| 6,652,115 | B2 | 11/2003 | Sharrah |
| 6,680,844 | B2 | 1/2004 | Kim |
| 6,718,136 | B2 | 4/2004 | Bird et al. |
| D489,839 | S | 5/2004 | Opolka |
| 6,762,584 | B2 | 7/2004 | Harvey |
| 6,764,202 | B1 | 7/2004 | Herring et al. |
| 6,808,289 | B2 | 10/2004 | Reed |
| 6,874,908 | B2 | 4/2005 | Sharrah et al. |
| 6,905,223 | B2 | 6/2005 | Halasz |
| 6,952,084 | B2 | 10/2005 | Bruwer |
| 6,953,259 | B2 | 10/2005 | Parsons et al. |
| 6,953,260 | B1 | 10/2005 | Allen |
| D518,212 | S | 3/2006 | Shiu |
| D518,584 | S | 4/2006 | Chan |
| 7,021,783 | B2 | 4/2006 | Quittner |
| 7,033,036 | B2 | 4/2006 | Pederson |
| 7,048,403 | B2 | 5/2006 | Parker et al. |
| D536,116 | S | 1/2007 | Sharrah |
| D548,384 | S | 8/2007 | Komar |
| D549,379 | S | 8/2007 | Sharrah et al. |
| 7,306,348 | B2 | 12/2007 | Quittner |
| 7,435,508 | B2 | 10/2008 | Lee et al. |
| 7,466,082 | B1 | 12/2008 | Snyder |
| 7,549,766 | B2 | 1/2009 | Sharrah |
| D589,186 | S | 3/2009 | Coushaine et al. |
| 7,497,584 | B1 | 3/2009 | Quittner |
| 7,497,591 | B1 | 3/2009 | Bix et al. |
| 7,513,662 | B2 | 4/2009 | Parker et al. |
| D595,875 | S | 7/2009 | Irvine |
| 7,581,847 | B2 | 9/2009 | Dalton |
| 7,582,838 | B2 | 9/2009 | Sharrah |
| D611,629 | S | 3/2010 | Sharrah et al. |
| 7,688,029 | B2 | 3/2010 | Hoffman |
| 7,802,909 | B2 | 9/2010 | Baker |
| 7,862,193 | B1 | 1/2011 | Quittner |
| D634,044 | S | 3/2011 | Eichelberger et al. |
| 7,984,998 | B1 | 7/2011 | Quittner |
| D645,179 | S | 9/2011 | Gulker |
| D647,229 | S | 10/2011 | Ma |
| 8,044,634 | B2 | 10/2011 | Hoffman |
| 8,066,396 | B2 | 11/2011 | Hunt |
| D650,933 | S | 12/2011 | Cheng |
| D653,798 | S | 2/2012 | Janice et al. |
| D655,433 | S | 3/2012 | Levine |
| D659,898 | S | 3/2012 | Aaskov et al. |
| D663,876 | S | 7/2012 | Tomita et al. |

(56) References Cited

U.S. PATENT DOCUMENTS

| | | | |
|---|---|---|---|
| D666,756 | S | 9/2012 | Kani et al. |
| D667,404 | S | 9/2012 | Akana et al. |
| 8,282,233 | B2 | 10/2012 | Quittner |
| D673,710 | S | 1/2013 | Eichelberger |
| D674,478 | S | 1/2013 | Inoue |
| 8,356,910 | B2 | 1/2013 | Messinger et al. |
| 8,403,515 | B2 | 3/2013 | Eichelberger |
| 8,511,847 | B2 | 8/2013 | Sharrah et al. |
| 8,648,567 | B2 | 2/2014 | Hoffman |
| 8,657,459 | B2 | 2/2014 | Janice et al. |
| D714,278 | S | 9/2014 | Case et al. |
| 8,888,311 | B2 | 11/2014 | Parsons |
| 9,057,490 | B2 | 6/2015 | Sharrah et al. |
| 9,206,951 | B2 | 12/2015 | McLennan et al. |
| 9,347,656 | B2 * | 5/2016 | McLennan ..... F21V 23/0414 |
| 2001/0048409 | A1 | 12/2001 | Kim |
| 2002/0191396 | A1 | 12/2002 | Reiff et al. |
| 2003/0112624 | A1 | 6/2003 | Quittner |
| 2003/0210543 | A1 | 11/2003 | Sharrah |
| 2003/0227770 | A1 | 12/2003 | Chen |
| 2005/0007778 | A1 | 1/2005 | Lin |
| 2005/0041428 | A1 | 2/2005 | Zhang |
| 2005/0231941 | A1 | 10/2005 | Huang |
| 2005/0280393 | A1 | 12/2005 | Feldmann |
| 2006/0091852 | A1 | 5/2006 | Watson |
| 2007/0030672 | A1 | 2/2007 | Offiler |
| 2007/0115672 | A1 | 5/2007 | Nelson et al. |
| 2007/0159809 | A1 | 7/2007 | Kim et al. |
| 2007/0159810 | A1 | 7/2007 | Kim |
| 2007/0171629 | A1 | 7/2007 | Langenwalter |
| 2007/0182368 | A1 | 8/2007 | Yang |
| 2008/0316736 | A1 | 11/2008 | Hunnewell et al. |
| 2009/0189548 | A1 | 7/2009 | Hoffman et al. |
| 2009/0290335 | A1 | 11/2009 | Levine |
| 2010/0002421 | A1 | 1/2010 | Arnold, III |
| 2010/0033960 | A1 | 2/2010 | Levine |
| 2010/0046211 | A1 | 2/2010 | Spartano |
| 2010/0165609 | A1 | 7/2010 | Sohn |
| 2010/0165633 | A1 | 7/2010 | Moolman et al. |
| 2010/0177507 | A1 | 7/2010 | West |
| 2010/0219775 | A1 | 9/2010 | Maglica |
| 2010/0301779 | A1 | 12/2010 | Spartano et al. |
| 2010/0330843 | A1 | 12/2010 | Gao et al. |
| 2012/0033414 | A1 | 2/2012 | Sharrah et al. |
| 2012/0195025 | A1 | 8/2012 | Gerolemou |
| 2012/0235593 | A1 | 9/2012 | Snyder et al. |
| 2012/0236551 | A1 | 9/2012 | Sharrah et al. |
| 2013/0182419 | A1 | 7/2013 | Woman |
| 2013/0335954 | A1 | 12/2013 | Sharrah et al. |
| 2014/0240967 | A1 | 8/2014 | Sharrah et al. |
| 2015/0029706 | A1 | 1/2015 | Parsons |

FOREIGN PATENT DOCUMENTS

| | | |
|---|---|---|
| JP | 3133833 | 7/2007 |
| JP | 2008-269974 | 11/2008 |
| WO | WO2004/111530 | 12/2004 |
| WO | WO2008/094013 | 8/2008 |

OTHER PUBLICATIONS

Streamlight, Inc., "Streamlight Jr.® Reach LED" Information, prior to Oct. 31, 2011, http://www.streamlight.com/product/product.aspx?pid=100, 2 pages.

Streamlight, Inc., "Streamlight Jr.® Reach LED Flashlight", Jan. 2012, 1 pg.

Streamlight, Inc., "Streamlight Jr.® Reach LED Product Fact Sheet", Dec. 21, 2011, Document #247, 1 page.

Eveready Lighting products, Catalog, Spring 1983, 24 Pages.

Promo-lite Brochure, published before May 2007, 4 Pages.

Stuart Schneider, "Collecting Flashlight With Value Guide", Schiffer Publishing Ltd, 1996, 22 Pages.

Raymond L. Sharrah, et al., "Portable Light", Design U.S. Appl. No. 29/398,479, filed Aug. 1, 2011, 9 pages.

Pelican Products, "2270 VersaBrite II Flashlight", date prior to Dec. 20, 2013, 1 page, http://www.pelican-cases-flashlights.com/2270-pelican-versabrite-ii.htm.

Pelican Products, "VersaBrite 2250/Deluxe Version 2250 C Instructions", © 2010, 2 pages.

Streamlight, Inc., "Stylus Reach Alkaline Battery-Powered Pen Light", Apr. 2012, 1 pg.

Streamlight, Inc., "Stylus Reach", © 2014, 1 pg, http://www.streamlight.com/en-gb/product/product.html?pid=53#.

Armament Systems and Procedures, "Triad USB—Micro USB Rechargeable LED Light", Press Release, Aug. 16, 2012, 2 pages, http://www.asp-usa.com/press-releases/triad-usb-micro-usb-rechargeable-led-light.html.

Light Reviewers, "NexTorch myTorch (18650) Review", Feb. 2011, 21 pages, http://lightreviewers.com/2011/02/nextorch-18650-review.html.

SureFire, LLC, "Headlamps", http://www.surefire.com/headlamps, © 2010, 3 pages.

Underwater Kinetics, "Vizion eLED—Waterproof LED Headlamp", © 2007, 1 page.

Lab Safety Supply, "Bright Star® WorkSafe® Razor Zone Zero Flashlight", © 2011 GHC Specialty Brands, LLC, www.labsafety.com/bright-star-worksafe-razor-zone-zero-flashlight_24535811, 2 pages.

Global Stores Group Industrial & Safety Division, "Bright Star Razor LED Flashlights", © 2006, www.allsafetysupplies.com/bright-star-razor-LED-flashlights_p_14674, 2 pages.

Bright Star, "Product Data Sheet: Razor 3AA-cell LED Flashlight", date prior to May 5, 2011, 1 pg.

Cat Eye Co., Ltd., "Headlights", http://www.cateye.com/en/product . . . , © 2010, 23 pages.

International Searching Authority/US, "International Search Report—Application No. PCT/US2011/046119", dated Dec. 12, 2011, 2 pages.

USPTO, "Notice of References Cited (PTO-892) U.S. Appl. No. 29/367,099", dated Dec. 12, 2012, 1 page.

Amazon.com , "ASP Triad USB LED Flashlight 35625", Printed on or about Sep. 9, 2014, 4 pages, http://www.amazon.com/ASP-Triad-USB-flashlight-35625/dp/B00AQ1RBPK.

Princeton Tec, "Charge—MPLS Specifications", printed Dec. 3, 2015, 6 pages (pp. 5-6, © 2011), http://princetontec.com/charge-mpls.

Japanese Patent Office, "Notice of Reasons for Refusal—JP Patent Application No. 2013-523244", Oct. 28, 2014, including English Translation, 6 pages.

European Patent Office, "Supplementary European Search Report—EP Patent Application No. 11815134.9", Dec. 1, 2014, 8 pages.

PCT International Searching Authority, "Notification of Transmittal of the International Search Report and the Written Opinion of the International Searching Authority, or the Declaration", in PCT/US2014/070334, dated Mar. 16, 2015, 11 pages.

* cited by examiner 10
20
21
22
30
34
36
40
400
50
52
54
56
58
59
60
64
70
88

FIGURE 3
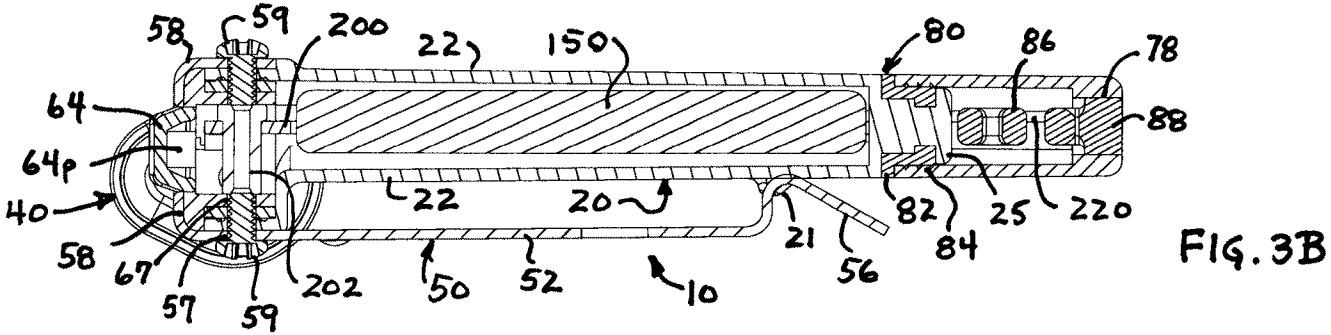
FIG. 3B
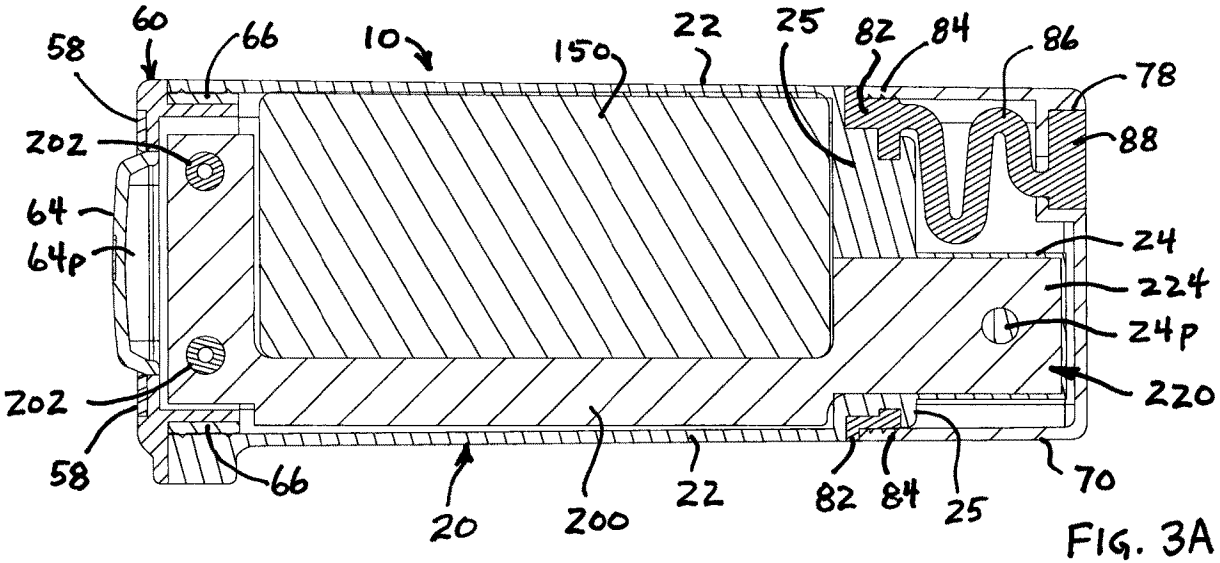
FIG. 3A

PORTABLE LIGHT HAVING A MOLDED HOUSING AND/OR A DUAL FUNCTION LIGHT SOURCE

This Application is a division of U.S. patent application Ser. No. 14/959,512 entitled "PORTABLE LIGHT HAVING A LIGHT SOURCE ON A FLEXIBLE STALK" which was filed on Dec. 4, 2015, now U.S. Pat. No. 9,347,656, which is a division of U.S. patent application Ser. No. 14/135,803 entitled "RECHARGEABLE CLIP-ON LIGHT WITH MALE USB CONNECTOR" which was filed on Dec. 20, 2013, now U.S. Pat. No. 9,206,951, each of which is hereby incorporated herein by reference in its entirety.

The present invention relates to a portable light and, in particular, to a portable light that has a molded housing and/or a dual function light source Rechargeable portable lights, e.g., flashlights, have become relatively commonplace as battery technology has advanced to provide small, lightweight, high energy density, reliable rechargeable batteries. Myriad devices are powered by such batteries of various electrical capacities, and charging and recharging such batteries has resulted in a myriad of different and not necessarily compatible charging devices. As a result it is not uncommon to see a person with 3 or 4 or more different charging devices for the plural electronic devices carried, e.g., a portable computer, a tablet computer, one or more cell phones and/or smart phones, electronic book (e-book) readers, flashlights, electronic equipment and the like.

Many of these rechargeable devices connect to a charging device via a cable of one sort or another, and so the person is likely to have to carry and manage, in addition to plural charging devices, plural cables for connecting his or her various electronic devices to their respective charging devices. Among these cables are various universal serial bus (USB) cables enabling connection to standardized USB connectors, e.g., of a charging device. In many instances, the USB cable connection may be an alternative to a main or primary charging arrangement, and so while the standardized cable may allow fewer cabled to be needed, it does not alleviate the complexity and inconvenience of needing plural cables and devices.

Prior art rechargeable flashlights are known that can be charged via a USB connection, e.g., a USB cable, and portable lights are known that can operate when plugged into a USB connector, e.g., a reading light that plugs into a portable computer or an electronic book reader (no battery needed). Prior art known devices often have additional complexity in order to be rechargeable via a USB or other standardized connection.

Applicant believes there may be a need for a portable light that is directly rechargeable from the power available at a standard USB connector. It would also be desirable if the portable light were to avoid unnecessary complexity in being rechargeable from a USB connector, thereby to simplify the light and reduce the cost thereof.

Applicant also believes there may be a need for a portable light that has a light head supported on a flexible stalk so that light can easily be directed in a desired direction relative to a body of the portable light.

Applicant also believes there may be a need for a portable light that has a molded housing including a USB connector and/or a light source having a dual function.

Accordingly, a portable light may comprise: a molded light housing having a cavity configured for receiving an electronic circuit board and including a tray for a USB connector integrally molded; a light source and an electrical switch actuatable for selectively energizing the light source; and a circuit board configured to provide electrical contacts of a USB connector that are disposed in the tray of the molded light housing to define a USB connector. The tray and the electrical contacts cooperate to provide a USB connector on the molded light housing.

A portable light housing may comprise: a molded housing having a cavity for receiving an electronic circuit board; the molded light housing including a tray for a USB connector integrally molded therewith; and a circuit board configured to provide electrical contacts of a USB connector that are disposed in the tray of the molded light housing to define a USB connector. The tray and the electrical contacts cooperate to provide a USB connector on the molded light housing.

A portable light may comprise: a light housing having a rechargeable source of electrical power; a light source and an electrical switch actuatable for selectively energizing the light source; a control circuit coupled to the light source, the electrical switch and the rechargeable source of electrical power for selectively energizing the light source and configured for coupling charging power to the rechargeable source of electrical power; and an electrical connector for receiving charging power from an external source, wherein the light source includes: a first light emitting diode operable in a first operating state for emitting illumination light and operable in a different operating state for providing an indication of charging of the rechargeable source of electrical power.

Further, a portable light may comprise: a light body; a source of electrical power disposable in the light body; a light head supported by the light body and including a light source; a switch for selectively actuating the light source; a USB connector on the light body for connecting to a source of electrical power; and an electronic circuit in the light body for controlling operation of the light source responsive to the electrical switch and for coupling electrical power received at the USB connector to the source of electrical power.

Further, A rechargeable portable light may comprise: a light body; a rechargeable source of electrical power disposable in the light body; a light head including a light source for producing light, wherein the light head is movable relative to the light body; a switch for selectively actuating the light source; an electronic circuit electrically connected for controlling operation of the light source responsive to the electrical switch; and a male USB connector on the light body for connecting to a source of charging power for charging the rechargeable source of electrical power.

According to another aspect, a rechargeable portable light may comprise: a light body; a rechargeable source of electrical power disposable in the light body; a flexible bendable stalk extending from the light body; a light head supported by the flexible bendable stalk including a light source for producing light, wherein the light head is movable relative to the light body; a switch for selectively actuating the light source; an electronic circuit electrically connected for controlling operation of the light source responsive to the electrical switch; and a male USB connector on the light body for connecting to a source of charging power for charging the rechargeable source of electrical power.

In another aspect, A rechargeable portable light may comprise: a light body; a rechargeable source of electrical power disposable in the light body; a light head including a light source for producing light; a switch for selectively actuating the light source from the rechargeable source of electrical power; a male USB connector on the light body for connecting to a source of charging power for receiving electrical power therefrom; and an electronic circuit electrically connected for controlling operation of the light source responsive to the electrical switch and for coupling electrical power received at the USB connector for charging the rechargeable source of electrical power.

In yet another aspect, a portable light may comprise: a generally rectangular light body having first and second opposing broad surfaces, having first and second sides and having first and second ends; a source of electrical power disposed in the generally rectangular light body; a flexible bendable stalk extending generally perpendicularly from the first side of the generally rectangular light body; a light head at a distal end of the flexible bendable stalk, the light head including a light source for producing light, wherein the light head is movable relative to the generally rectangular light body; a switch actuator on the first end of the generally rectangular light body for selectively actuating the light source; and an electronic circuit electrically connected to the source of electrical power and to the light source for controlling operation of the light source responsive to the electrical switch.

Further, a portable light may comprise: a light body; a source of electrical power in the light body; a flexible bendable stalk extending from the light body and supported thereby; a light head supported by the flexible bendable stalk and movable for directing light in different directions; a switch actuator on the light body for selectively actuating the light source; and an electronic circuit in the light body for controlling operation of the light source responsive to the electrical switch.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so is not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include:

FIG. 3 includes FIGS. 3A and 3B which are cross-sectional views of the example portable light of FIG. 1 taken at perpendicular directions;

Figures 1, 1A, 1B, 1C:
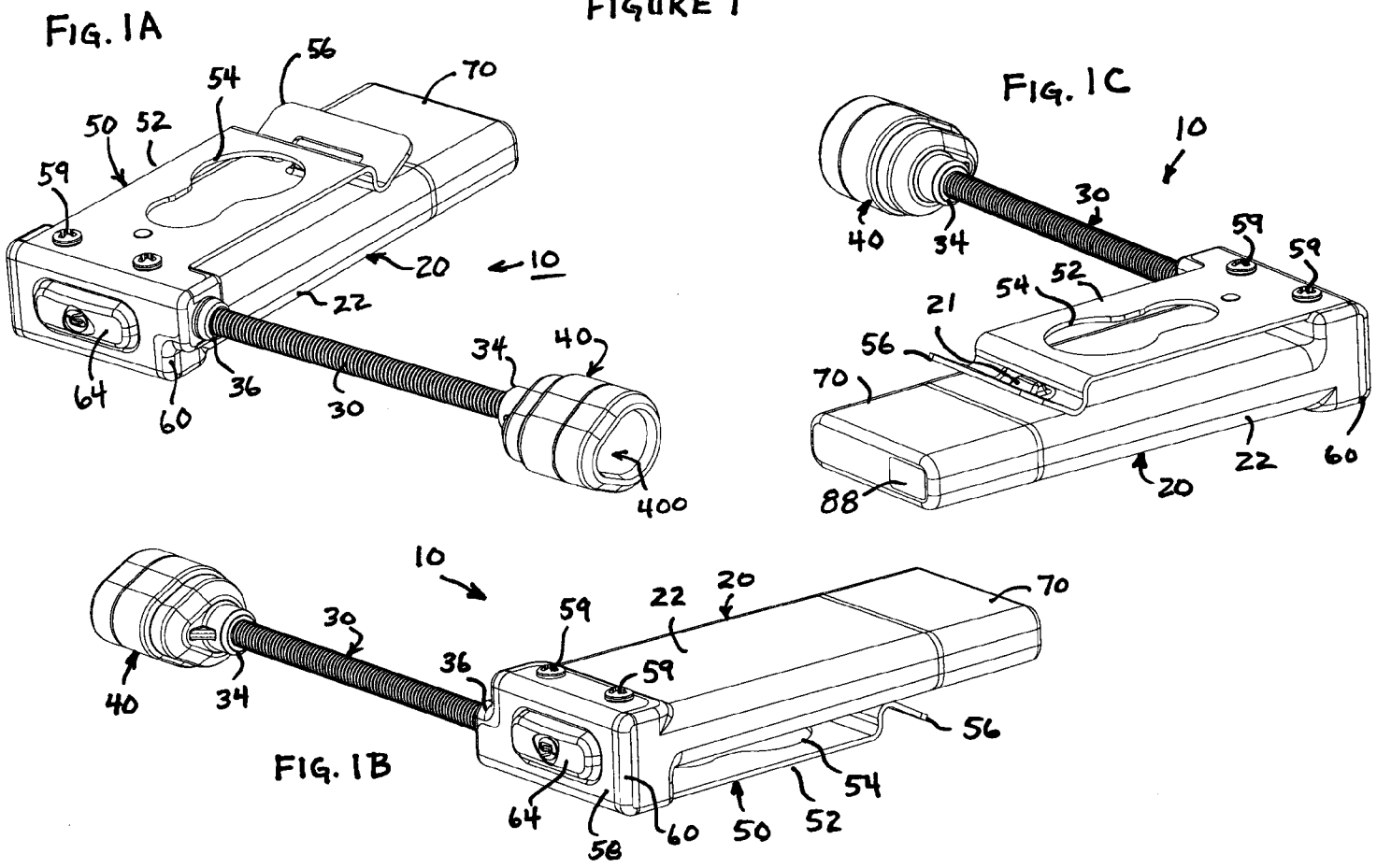
FIG. 1 includes FIGS. 1A, 1B, 1C and 1D which are different perspective views of an example embodiment of a clip-on portable light having a USB connector.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

FIG. 1 includes FIGS. 1A, 1B, 1C and 1D which are four different perspective views of an example embodiment of a clip-on rechargeable portable light 10 having a USB connector 220. Portable light 10 includes a light body 20 which houses and/or supports various operative elements of the light 10, including, e.g., flexible stalk 30, light head 40, clip 50 and USB cap 70. The different perspective views allow for both broad side surfaces and both narrow side surfaces of light 10 and both ends thereof to be viewed, including a view in FIG. 1D with USB cap 70 removed to expose USB connector 220. USB connector 220 is preferably a male USB connector for being mated with a female USB connector of a source of electrical charging power for the rechargeable battery disposed in the light body 20 of rechargeable portable light 10.

Flexible stalk 30 is flexible and bendable to a wide variety of different shapes so that illuminating light produced by light head 40 can be directed in any of a wide range of desired directions, irrespective of whether portable light 10 is placed on a surface or is clipped or attached to an object by clip 50. Conveniently, portable light 10 can be carried in a pocket, e.g., a shirt or jacket pocket, or on a belt or on headgear or on another article of clothing, where it can be retained by clip 50, and stalk 30 can be bent to a desired shape for directing light produced by light head 40 in any of a wide range of desired directions. Light can be directed generally in any direction relative to light body 20 by bending flexible bendable stalk 30 appropriately, including to angles up to and/or substantially exceeding up to about ±180° relative to the straight stalk position illustrated, so as to direct light in any radial direction substantially exceeding, e.g., the directions of radials of a more than 180° hemisphere centered proximate the base 36 of stalk 30.

Generally rectangular light body 20 includes a generally rectangular housing 22 having an end cap 60 at one end covering an internal cavity for receiving a source of electrical power, e.g., a rechargeable battery, and a USB connector 220 at the opposite end which is covered by USB cap 70 as illustrated. Light body 20 receives base 36 of flexible stalk 30 for supporting stalk 30 which supports at its distal end 34 the light head 40 which includes a light source 400, e.g., one or more light emitting diodes (LEDs). Light body 20 also supports clip 50 which is fastened thereto by plural fasteners 58.

Clip 50 has a springy elongated clip prong 52 that extends substantially parallel to light body 20 and that has a shaped distal end 56 that is urged by the springiness of clip 50 to bear close to and/or against light body 20, for clipping or otherwise attaching light 20 to an object, e.g., a belt, clothing, equipment and/or any other relatively thin part of an object. Clip 50 also has a keyhole shaped opening 54 in elongated clip prong 52 for attaching clip 50 and light 10 to a compatible mounting post of a light mount. Clip 50 is attached to light body 20 at its U-shaped end 58 by a plurality of fasteners 59. For improving the grip of clip light 10 on an object, in particular a non-rigid object such as an article of clothing, light body 20 may have a projection 21 proximate the bend of distal end 56 of clip 50 and in addition distal end 56 may have a corresponding opening into which projection 21 extends.

End cap 60 may provide a switch actuator 64 by which the light of portable light 10 can be actuated as is described below, and the U-shaped end 58 of clip 50 has a corresponding opening through which actuator 64 is accessible. USB cap 70 is removable and preferably can slip onto and off of a male USB connector 220, e.g., at the end of light body 20, which is not visible in FIGS. 1A-1C.

Figure 1D:
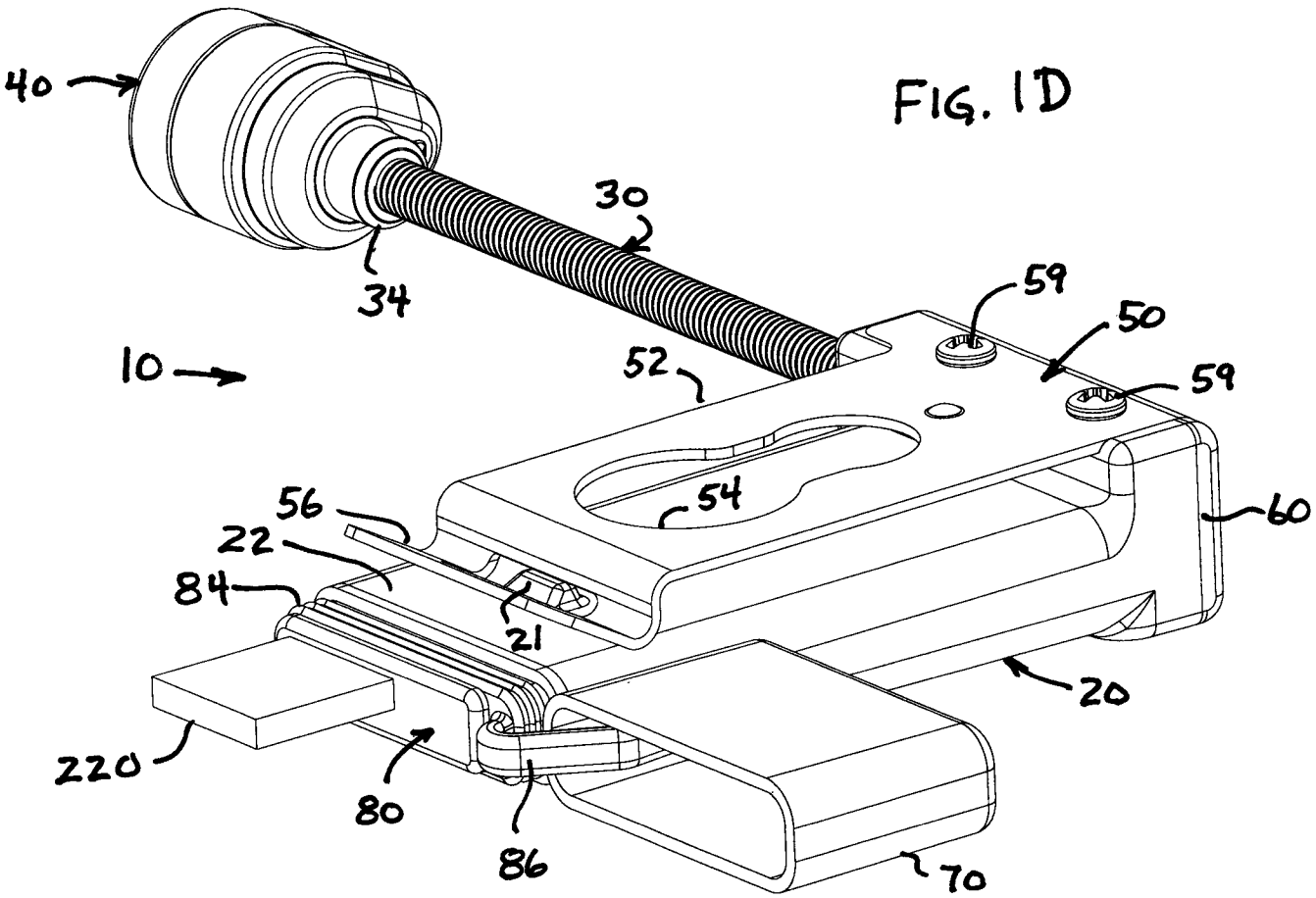

FIG. 1D is a perspective view of one end of the example portable light 10 of FIG. 1 with USB cap 70 removed. With USB cap 70 removed the male USB connector 220 extending from the distal end of light body 20 is exposed and visible, and so is available for being plugged into a female USB connector, e.g., on a charging device, computer, vehicle, mobile device or other source of charging power for electrically charging a rechargeable battery enclosed in light body 20. Also exposed are exterior sealing ridges 84 of USB end cap 80 that are preferably provided for retaining USB cap 50 on light body 20, preferably with a weatherproof seal.

Optionally, but preferably, USB cap 70 is attached to the remainder of light 10 by a flexible cord or tether 86, preferably an elastomer tether 86. The distal end 88 of tether 86 may be secured in a seat 78 of USB cap 70. The electrical connections of male USB connector 220 may be disposed in a USB tray 24 which preferably may be part of housing 22 or alternatively may be part of an end cap or cover 80 for the distal end of housing 22.

Figure 2:
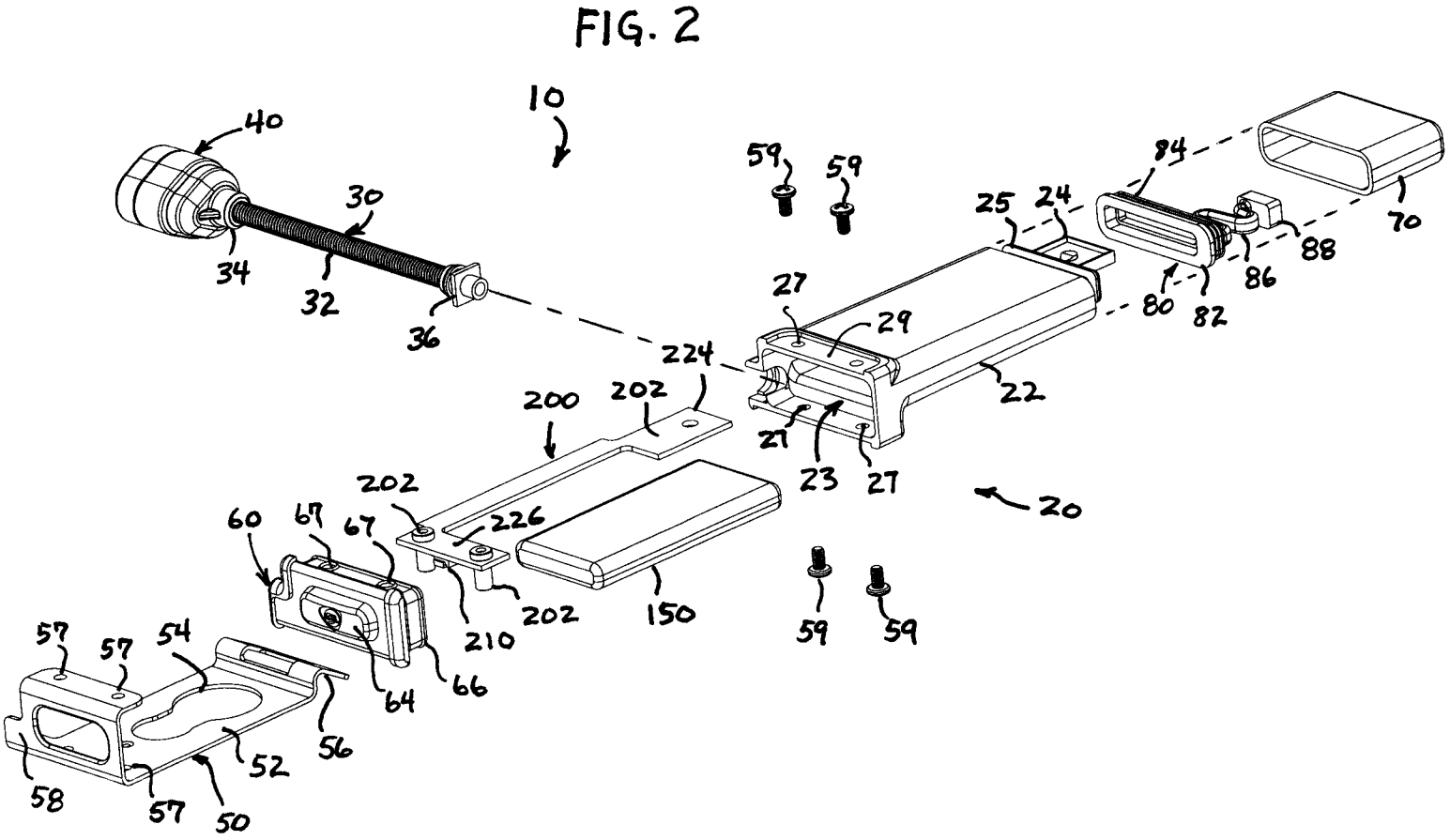
FIG. 2 is an exploded perspective view of the example portable light of FIG. 1.

FIG. 2 is an exploded perspective view of the example portable light 10 of FIG. 1. Substantially rectangular housing 22 of light body 20 may have four relatively planar walls, e.g., two having a broader exterior surface and two having a narrower exterior surface, and may be open or partially open at its opposing ends. An end cap 60 may be employed for closing a first or front end and a USB cap seal 80 may be employed for closing and/or sealing a second or rear end of light body 20.

The front end 23 of housing 22 preferably has a shaped opening for supporting flexible stalk 30 at its base 36, for receiving end cap 60 and for supporting U-shaped end 58 of clip 50. In general, stalk base 36 and stalk base support 26 have complementary shapes, e.g., as may be provided by a complementary recess and projection, e.g., one or more grooves and one or more complementary ridges or flanges, so that stalk 30 is supported at its base 36 by light body 20 and is retained thereon in a desired position.

For example, as shown in FIG. 2, stalk base support 26 may be provided by a circular opening 26 in one wall of housing 22 which may be configured for receiving the base end 36 of flexible stalk tube 32 of flexible stalk 30 and may have a radial groove 26 for receiving a base flange 36 of stalk 30, thereby to retain stalk 30 in light body 20. Stalk base 36 and radial groove 26 may have, but need not have, generally corresponding shapes, and end cap 60 may provide the remainder of the circular opening 26 and groove 26. The shapes of stalk base 36 and groove 26 may be circular or partly circular for enabling flexible stalk 30 to be rotated relative to light body 20, whether or not the amount of rotation is limited by a stop, or may have non-circular shapes for restricting such rotation of stalk 30, as illustrated in FIG. 2, wherein stalk base 36 is non-circular as is groove 26 for receiving stalk base 36.

Figure 4:
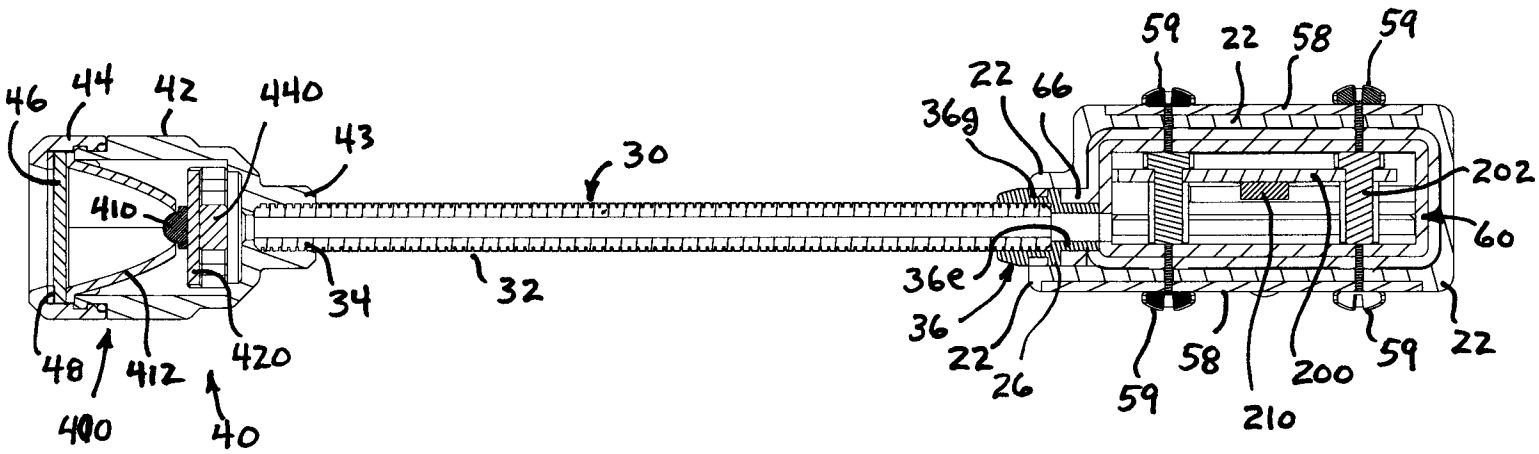
FIG. 4 is a cross-sectional view of the stalk end of the example portable light of FIG. 1 and includes FIG. 4A which is a cross-sectional view of the example light head of the example portable light of FIG. 1 taken at a direction perpendicular to the view of FIG. 4.

Alternatively, as illustrated in FIG. 4, stalk base 36 may have an external groove that receives an outwardly extending flange 26 of housing 22. Even where the groove of stalk base 36 and the flange of stalk base support 26 are circular, stalk base 36 may tightly engage base support 26 so that stalk 30 is not rotatable relative to light body 20, or stalk base 36 and/or base support 26 may have a stop that limits rotation of stalk 30 relative to light body 20.

The opposite end 26 of housing 22 preferably is preferably partially closed and shaped for allowing part of USB connector 220 to pass therethrough and providing a seat 25 for receiving USB seal cap 80. Housing end 25 partially closes the end of housing 22 and provides an outward facing ridge or flange that serves to retain USB cap seal 80 thereon. End 25 preferably includes a USB tray 24 into which electrical contacts 224 of a USB connector may be disposed thereby to provide the male USB connector 220.

USB cap seal 80 is preferably a single piece molded elastomer cap 80 that provides an oval base 82 of similar shape to the cross-sectional shape of the end 26 of housing 22 and the open end of USB cap 70, but of slightly smaller dimension at the distal end 84 thereof for receiving and retaining USB cap 70 thereon. Oval base 82 thereof preferably has a groove or recess on its interior surface that is shaped to engage the flange of end 25 of housing 22 for retaining USB cap seal 80 on light housing 22 in a sealing manner.

USB cap seal 80 has a central opening through which tray 24 and contacts 224 of male USB connector 220 are disposed. A seal for USB connector 220 at the central opening of USB end cap 80 is not needed because a seal is provided between USB cap seal 80 and USB cap 70. Preferably, distal end 84 may have one or more raised ridges 84 for providing a seal with the open end of USB cap 70, and may have a serpentine cord or tether 86 extending therefrom for attaching to USB cap 70 for tethering cap 70 to light body 20.

Tether 86 preferably has an end 88 that is shaped to be disposed and retained in an opening or seat 78 of USB cap 70, e.g., for facilitating attachment of cap 70 to tether 86. Tether 86 is preferably molded integrally with USB cap seal 80 in its retracted serpentine shape and size so as to naturally fit adjacent to USB connector 220 within USB cap 70 when USB cap 70 is placed onto cap seal 80 of light body 20.

End cap 60 is disposed at the forward end 23 of housing 22 for closing and providing a seal at end 23. A source of electrical power 150, e.g., a rechargeable battery 150, and electronic circuit board 200 are connected and disposed in the interior cavity of light housing 22 before end cap 60 is disposed in the end thereof. Electronic circuit board 200 contains electronic circuitry for controlling the operation of light 10 and for selectively applying electrical power from battery 150 to light source 400 of light head 40 to produce light. The light produced by light source 400 is directed outwardly in accordance with the orientation to which light head 40 at the end of flexible stalk 30 is placed relative to light body 20.

Electronic circuit board 200 is, e.g., disposed adjacent all or part of three narrow edges of battery 150 in the example embodiment illustrated, but may be of another shape and/or placed in another location within light body 20. In the illustrated arrangement, an extension 222 at one end of circuit board 200 supports the electrical contacts 224 of male USB connector 220 and is shaped to be disposed in USB tray 24 of housing 22 thereby to provide a male USB connector that extends outwardly from the end 25 of housing 22.

The other end 226 of circuit board 220 extends proximate the shorter narrow edge of battery 150 for making electrical connection thereto and for supporting an electrical switch 210 which is actuated via switch actuator 64 of end cap 60 for selectively controlling operation of light source 400. Contact pads may also be provided at end 226 of circuit board 200 for connecting to electrical wires that lead through stalk 30 to a light source 400 in light head 40. Typically, electrical connections to circuit board 200 are by solder connections, although other kinds of electrically conductive connections, e.g., spring contacts or electrically conductive adhesive, may be employed.

Also at end 226 of circuit board 200 are one or more inserts 202 for receiving fasteners 59 used in assembling light 10. Preferably inserts 202 are press fit and/or swaged into holes in circuit board 200 and provide a threaded central hole that receives threaded fasteners 59. When circuit board 200 is disposed in housing 22, the threaded inserts 202 thereof align with respective holes 27 of housing 20, whereby fasteners 59 may pass through holes 27 and into inserts 202.

An advantage of the foregoing example arrangement of electronic circuit board 200 is that a single circuit board is employed to provide the male USB connector 220, 224, the electrical switch 210, connections to a rechargeable battery 150 and connections to a light source 400, thereby reducing complexity, simplifying assembly and reducing the size, particularly the thickness, of portable light 10. Electronic circuit board 200 may include any one of many different electronic circuits for controlling and operating light 10, including micro-processor controlled programmable electronic circuitry. Further, circuit board 200 may be assembled and may optionally be tested outside of light housing 22 and in addition can easily be packaged (assembled) into a simple, lightweight housing, e.g., housing 22, as described below.

End cap 60 has a body that covers the opening of end 23 of housing 22 and that extends into the cavity of housing 22. The body of end cap 60 is preferably a molded plastic part having a molded elastomer outer layer that provides a flexible switch actuator 64 over an opening on the exposed end thereof and one or more sealing ridges 66 for providing a seal between end cap 60 and housing 22, e.g., a weatherproof seal. When end cap 60 is disposed in end 23 of housing 22, the threaded inserts 202 of circuit board 200 align with respective holes 67 of end cap 60 and holes 27 of housing 20, whereby fasteners 59 may pass through holes 27 and 67 and into inserts 202.

Clip 50 preferably has a U-shaped end 58 that is of a size and shape to fit closely over end cap 60 when end cap 60 is disposed in housing 22 which has respective seats or recesses 29 for receiving the U-shaped end 58 of clip 50. When so disposed, the distal end 56 of clip 50 is adjacent to light body 20 in a position for conveniently attaching light 10 to an object of suitable thickness and keyhole shaped opening 54 is spaced away from light body 20 by a distance suitable for allowing a suitable post to engage clip 50 at opening 54.

U-shaped end 58 of clip 50 preferably has plural holes 57 through which respective fasteners 59 may be disposed. When U-shaped end 58 of clip 50 is disposed over end cap 60 which is disposed in end 23 of housing 22, the threaded inserts 202 of circuit board 200 align with respective holes 57 of clip 50, holes 67 of end cap 60 and holes 27 of housing 20, whereby fasteners 59 may be placed through holes 57, 27 and 67 to engage inserts 202 and secure light 10 in an assembled condition. Holes 67 preferably have respective sealing ridges that cooperate with sealing ridges 66 for providing a more complete seal between end cap 60 and housing 22. It is noted that the foregoing arrangement of clip 50, end cap 60 and light housing 22 is believed to provide a relatively robust structure and seal for light body 20.

FIG. 3 includes FIGS. 3A and 3B which are cross-sectional views of the example portable light 10 of FIG. 1 taken at two perpendicular directions. One cross-section is taken parallel to the broad surfaces of housing 22 to show, e.g., the relative locations of battery 150 and electronic circuit board 200 in the interior cavity of housing 22. The other is taken parallel to the longer narrow edges of housing 22 to show, e.g., the relative locations of U-shaped end 58 of clip 20, end cap 60 and housing 22, and the stowed arrangement of tether 86. Both of FIGS. 3A and 3B show the sealing arrangements of end cap 60 and USB end seal 80 with housing 22. Previously described features of light 10 are not again described here except as convenient to the description of features evident in the cross-sectional views.

For example, at the left end 23 of housing 22, the elastomer layer 66 of end cap 60 that provides flexible switch actuator 64 and sealing ridges 66 is visible to show the seal between sealing ridges 66 of end cap 60 and housing 22 and to show the elastomer extension or post 64*p* of elastomer switch actuator 64 that extends inwardly so as to be closely adjacent to electrical switch 210 for effecting actuation of switch 210 when flexible actuator 64 is pressed inwardly, thereby to provide control of the operation of light 10 by a user thereof. The opening of end cap 60 covered by actuator 64 is visible as are the narrow portions of U-shaped end 58 of clip 50 that are adjacent to flexible actuator 64.

At the right end, the base oval 82 of elastomer USB cap seal 80 is seen to have an inwardly extending flange to engage a groove of housing 22 defined by flange 25 thereof to provide a seal to housing 22 and the outer sealing ridges 84 of USB end cap 80 engage USB cap 70 to provide a retaining and sealing connection therewith, e.g., a weatherproof seal. Tether 86 is seen to be integral to USB cap seal 80 and to have a serpentine shape when stowed that tends to naturally fit in a space adjacent to male USB connector 220 when USB cap 70 is on the end of light body 20, and is of sufficient length to provide sufficient slack for the easy removal of USB cap 70. Because the elastomer of which tether 86 is made is flexible and extensible (very "stretchy"), tether 86 can both straighten and stretch for enabling USB cap 70 to be removed from and placed on the end 80 of light body 20.

Enlarged end 88 of tether 86 is, e.g., generally rectangular and is removably disposed in a correspondingly shaped recess of USB cap 70 for being retained therein, whereby USB cap 70 is retained to light body 20 so as to not easily become misplaced or lost. Because tether end 88 is removable from USB cap 70, is allows a "break away" feature so as to avoid damage to USB cap 70 and/or light body 20 should excessive force be applied, e.g., when removing USB cap 70.

Male USB connector 24 is seen to have male USB contacts 224 of circuit board 200 disposed in USB tray 24 which has a post 24*p* for a corresponding opening in circuit board 200 for positioning USB contacts 224 in the desired position in USB tray 24 thereby to provide the standard-compliant male USB connector 220, e.g., a Type A USB connector (male plug). Because in a preferred arrangement the USB tray 24 is integrally molded with housing 22, tray 24 has sufficient strength to support the remainder of portable light 10 when male USB connector 220 is mated with a female USB connector, thereby eliminating the need for a metal sleeve commonly found on surrounding the contacts of standard USB connectors. The female USB connector may be associated with, e.g., a source of electrical charging power for recharging battery 150. The female USB connector may be associated with another electronic device, e.g., a computer (desktop or portable), a power pack, an AC-DC or DC-DC charging device or another source of auxiliary charging power.

Again at the left end, fasteners 59 are seen to extend through holes 57 of the U-shaped end 58 of clip 50, holes 27 of the end 23 of housing 22 and holes 67 of end cap 60 to engage fasteners 202 of electronic circuit board 200, thereby to clamp the assembly of clip 50, end cap 60, housing 22 and inserts 202 together in compression.

Figure 4A:
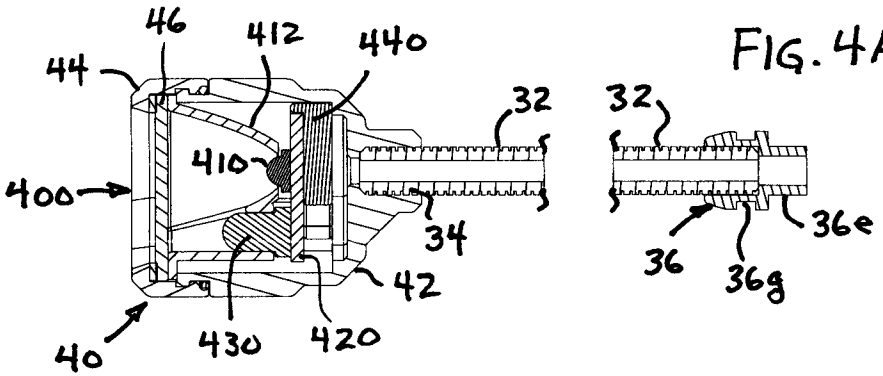

FIG. 4 is a cross-sectional view of the stalk 30 end of the example portable light 10 of FIG. 1 and includes FIG. 4A which is a cross-sectional view of the example light head 40 of the example portable light 10 of FIG. 1 taken at a direction perpendicular to the cross-sectional view of FIG. 4. The cross-section of FIG. 4A is taken along the centerline of stalk 30 in a direction that sections light head 40 across its shorter transverse dimension and sections light body 20 across its thinner dimension.

Light head 40 includes a light housing 42 that has a lens ring 44 at the end thereof distal stalk 30 that retains a lens 46 on light housing 42. A seal 48, e.g., an elastomer seal 48, may be provided between the periphery of lens 46 and lens ring 44. Light head 40 is attached at its narrow end 43, which is distal lens 46, to the distal end 34 of stalk tube 32 of stalk 30, and may be secured thereto by a press fit, threads, adhesive, or any suitable means.

Base end 36 of stalk 30 is attached to light body 20 at support 26 of housing 22 and, in this example, has a ferrule or collar 36 on stalk tube 32, which collar 36 has an exterior circumferential groove 36*g* that engages an outwardly extending flange 26 of support 26 of housing 22, thereby to secure stalk 30 to light body 20. Preferably, interior to support 26, elastomer overlay 66 of end cap 60 is disposed between stalk end 36*e* and support 26 of housing 22, and more preferably is compressed therebetween, thereby to provide a seal therebetween at the base 36 of stalk 30. Ferrule or collar 36 may be threaded to or otherwise attached to stalk tube 32, and if the helical exterior of stalk tube 32 is threaded into support 26, then ferrule 36 may provide a locking nut arrangement.

Light source 400 is disposed interior to light head 40 opposite lens 46 so as to project illuminating light forwardly through lens 46, e.g., in a desired direction forwardly from light head 40. Light head 400 preferably includes a light emitting diode (LED) 410, e.g., an LED 410 that produces white light, which is adjacent and thermally coupled to a heat sink 440. LED 410 may be positioned at the base of a reflector 412, e.g., a generally parabolic reflector 412. Preferably LED 410 is mounted to a thermally conductive circuit board 420 that is thermally mounted to heat sink 440 and that provides electrical connections between electrical conductors disposed in tube 32 of stalk 30 and LED 410.

At the right end, in the cross-section of light body 20, fasteners 59 are seen to extend through holes 57 of the U-shaped end 58 of clip 50, holes 27 of the end 23 of housing 22 and holes 67 of end cap 60 to engage respective inserts 202 of electronic circuit board 200, thereby to clamp the assembly of clip 50, end cap 60, housing 22 and inserts 202 together in compression. Inserts 202 are preferably "top hat" shaped and press into respective holes in electronic circuit board 200.

Therein is seen that electronic circuit board 200 is preferably offset from the center of housing 22 so that electrical switch 210 is approximately centered therein, and therefore switch 210 is approximately centered adjacent the end of post 64*p* of switch actuator 64 for being actuated thereby.

In the cross-section of light head 40 of FIG. 4A a second LED 430 is visible that is mounted by its leads to circuit board 420. Second LED 430 may be a colored LED or an LED of lower light output than LED 410. Typically, and preferably, the electronic control circuit 300 of electronic circuit board 200 is programmable for changing the electrical power applied to LED 410 and so can provide a function for the dimming (decreasing the brightness) and un-dimming (increasing the brightness) of LED 410. This feature beneficially makes it unnecessary for the second LED 430 to be a lower output white LED, and so second LED 430 may be of a different color, e.g., a red or a green LED 430, for providing a lower brightness colored light that does not appreciably diminish night vision.

Where one LED is a higher power LED, e.g., LED 410, and the other is a lower power LED, e.g., LED 420, light head 40 may be "tear drop" shaped as illustrated which efficiently meets the need for a larger mounting space for the higher power LED 410 and its thermally conductive circuit board 420 and heat sink 440, and a smaller space for lower power LED 430 which does not require a heat sink, but may be mounted by soldering its leads to the circuit board 420.

Plural electrical conductors need to be provided for electrically connecting light source 400 to the electronic control circuit 300 of circuit board 200 which connects to power source 150 and electrical control switch 210. Where stalk tube 32 is of a metal or other electrically conductive material, e.g., a helically wound metal wire flexible tube, it may provide one electrical conductor. One or more electrical wires are provided through stalk 30 to provide the remaining connections. Where one LED is employed, only two conductors are needed, and where plural LEDs are employed, three or more conductors are needed if the plural LEDs are to be independently controlled. In the example light 10 described, four electrical conductors are provided in the form of four insulated wires disposed through stalk tube 32, even where stalk tube 32 may be a helically wound metal tube.

The method of assembly of portable clip on light 10 is preferably as follows. The plural electrical wires, e.g., four wires, connecting to LEDs 410, 430, which are soldered to light head circuit board 420, are fed through stalk 30 and attached adapter nut or ferrule 36 and then through the end cap 60 and are soldered to respective contact pads of electronic circuit board 200, which preferably is a printed wiring circuit board 200 that already has all of its electronic components soldered or otherwise attached thereto. A power source 150, preferably a lithium polymer rechargeable battery 150, is then positioned adjacent to circuit board 200 and is soldered to provided circuit pads of circuit board 200. This completes the assembly of the electronic circuitry of light 10, which includes the light head 40, stalk 30, circuit board 200 and rechargeable battery 150, is functional and may be operated, e.g., for testing, if desired, before it is installed into housing 22.

The rechargeable battery 150 and circuit board 200 of the assembled electronic circuitry assembly is inserted into the housing 22 and the distal end of circuit board 200 carrying USB contacts 224 slips into USB tray 24 which is preferably molded as part of housing 22, thereby to provide a male USB connector 220, e.g., a Type A USB plug. The base 36 of stalk 30 is positioned into support 26 therefor and adapter nut (ferrule) 36 of stalk 30 fits into its mating area 26 for providing support for stalk 30 on light body 20. End cap 60 is slipped into end 23 of housing 22 to complete light body 20 and secure stalk 30 thereto.

The U-shaped end 58 of clip 50 is placed over end cap 60 and into the recess seats 29 therefor. Fasteners 59 are then inserted through now aligned holes 57, 27, and 67 into threaded inserts 202 of circuit board 200 and secured, e.g., threaded into inserts 202. Elastomer USB cap seal 80 is stretched over flange 25 and USB tray 24 of housing 22 where it self retains, but could be secured by adhesive if desired. End 88 of tether 86 is inserted into its seat 78 in USB cap 70, either before or after USB end cap 80 is installed on housing 22.

Figure 5:
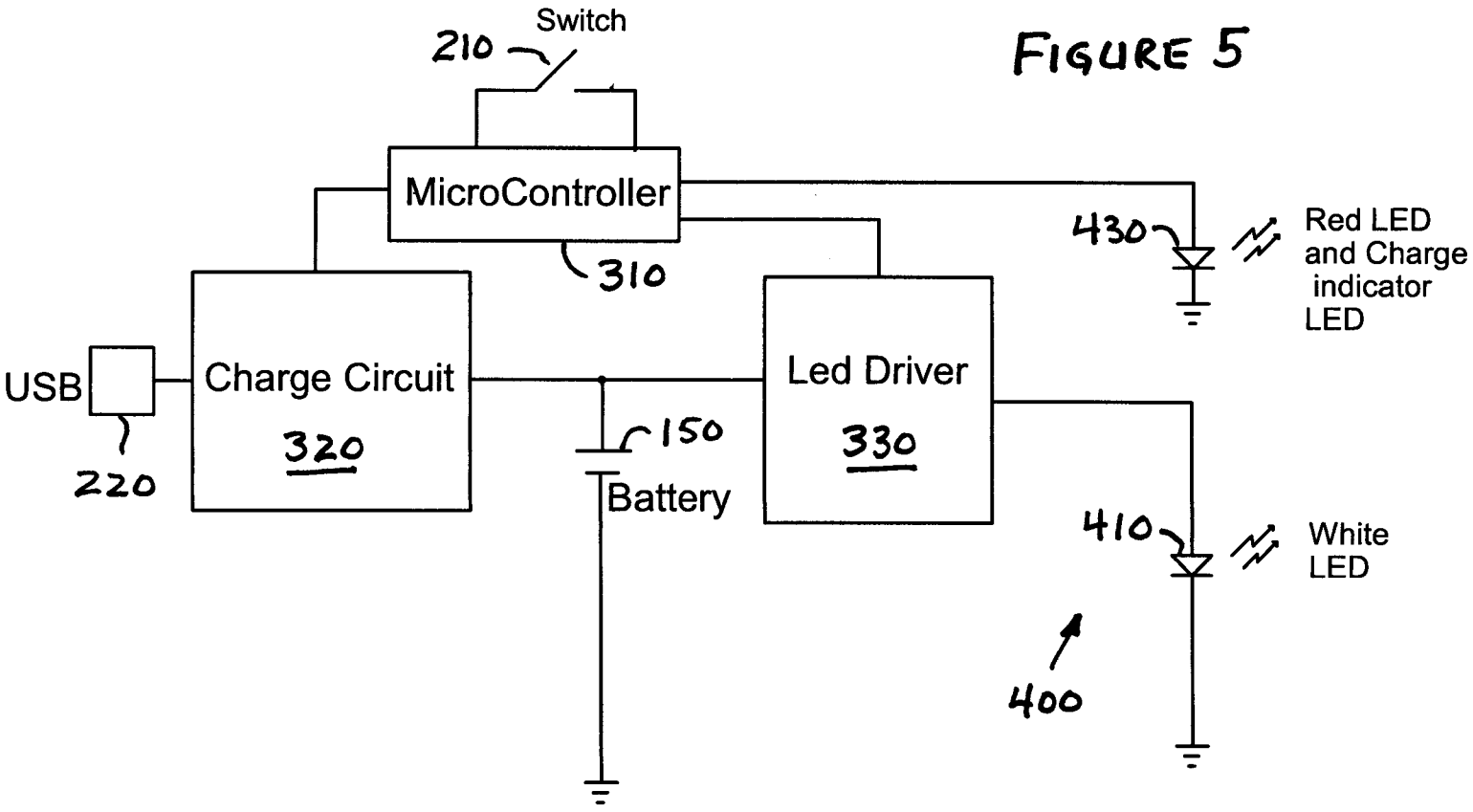
FIG. 5 is an electrical schematic diagram of an example embodiment of an electronic circuit suitable for the example portable light of FIG. 1.

FIG. 5 is an electrical schematic diagram of an example embodiment of an electronic circuit 300 suitable for the example portable light 10 of FIG. 1. Circuit 300 is preferably controlled by a micro-controller 310 for both operating light source 400 via LED driver 330 and for coupling charging power from USB connector 220 to rechargeable battery 150 via charging circuit 310. USB connector 220 may be connected to a source of electrical charging power directly, as by being plugged into a compatible USB connector of the power source, or indirectly, as by being plugged into a wire or cable having a compatible USB connector and that is connected either directly or indirectly to a source of electrical power.

When USB connector 220 of light 10 is plugged into a compatible USB connector having electrical power available, typically power at a voltage of about 5 volts, with about 200 milliamperes maximum current flow, the presence of electrical power thereat is coupled via charge circuit 320 to micro-controller 310 which senses the presence of electrical power at USB connector 220 suitable for charging battery 150. If micro-controller 310 determines that battery 150 is not fully charged, e.g., by determining the terminal voltage of battery 150, then micro-controller 310 enables charge circuit 320 to conduct current from USB connector 220 to battery 150 for charging battery 150. Micro-controller 310 is preferably powered by battery 150 so as to be operative to receive commands from switch 210.

Micro-controller 310 may be programmed to dim or extinguish light source 400 when battery 150 is charging or may be programmed to allow light source 400 to continue to operate for producing illumination while battery 150 is being charged, either by factory programming or by operator programming, or both. Because the current available via USB connector 220 is limited, the time required to charge battery 150 can be significantly longer if light source 400 is operating for producing light while battery 150 is being charged.

Micro-controller 310 preferably monitors the terminal voltage of battery 150 while battery 150 is being charged so as to reduce or remove charging current as battery 150 approaches or reaches a voltage indicative of being fully charged, thereby to prevent damage to battery 150, e.g., by over-charging or by rising temperature. Micro-controller 310 may also monitor the terminal voltage of battery 150 while battery 150 is being discharged so as to reduce or remove the load current as battery 150 approaches or reaches a voltage indicative of being fully discharged, thereby also to prevent damage to battery 150. Certain types of batteries may be more tolerant of over-charging and/or over discharging, e.g., a nickel-cadmium battery, whereas other battery types, e.g., lithium ion and lithium polymer batteries, may be more easily damaged by excessive charging and/or discharging. In a preferred embodiment, both charging and discharging are limited by micro-controller 310.

Micro-controller 310 is responsive to operation of electrical switch 210 for controlling operation of LED driver 330 for operating illumination LED 410 at one or more predetermined levels of electrical current for producing one or more levels of brightness of illumination. LED 410 may be operated at its maximum brightness and may be dimmed responsive to operator actuation of switch 210 and/or to micro-controller 310 determining that battery 150 is becoming discharged sufficiently that the brightness of LED 410 should be reduced to conserve the battery power and extend the operating time (also referred to as "run time") of LED 410 until battery 150 becomes fully discharged.

Charge circuit 320 typically transforms the voltage received at USB connector 220 to a voltage and current suitable for safely charging battery 150. LED driver 330 preferably transforms the voltage of battery 150 at which electrical power is provided to a suitable voltage and current for operating LED 410, and more preferably controls the current flowing in LED 410 to one or more desired predetermined values. Typically both charge circuit 320 and LED driver 150 include a DC converter circuit for so transforming voltage and current. This is because the range of voltages of battery 150 may include voltages above the 5 volts received at USB connector 220, or voltages below that voltage, or voltages both above and below that voltage, and/or the range of voltages of LED 410 when driven by LED driver at one or more predetermined currents may include voltages above the battery 150 voltage, or voltages below the battery 150 voltage, or voltages both above and below the battery 150 voltage Optionally, light 10 may include a charge indicator light, e.g., as provided by LED 430. Because LED 430 is an indicator and requires a relatively low current to produce sufficient light to give an indication, LED 430 may be operated directly from an output pin of micro-controller 310. Where LED 430 is operated as an alternative source of illumination, e.g., as a low level red light source LED 430, it may be operated directly by micro-controller 310. Alternatively, LED 430 may be operated by an additional output from LED driver 330 under control of micro-controller 310 or by an additional LED driver 330 under control of micro-controller 310, as may be convenient and desired, e.g., where the current required by LED 430 exceeds that available from a pin of micro-controller 310 or where powering LED 430 from micro-controller 430 is deemed inefficient.

LED 430 may be operated as an indicator at certain times, e.g., when battery 150 is being charged, and/or as a source of illumination at other times, e.g., when a low brightness light or a certain color of light is desired, e.g., a dim red light for avoiding loss of night vision. In a preferred embodiment, LED 430 is utilized as both, e.g., a source of low level red light and as an indicator of battery charging. Stalk 30 provides an advantage that light produced by LED 430 when utiltized as a charging indicator may be directed so as to be visible to a person.

Micro-controller 310 is programmable responsive to actuation of switch 210 which may have a single contact (pole) as illustrated or may have plural contacts (poles). In a most basic arrangement, micro-controller 310 is responsive to the closing and opening of the one or more contacts of switch 210 to provide operating states including LED 410 ON momentarily, LED 410 ON continuously, and LED 410 OFF. In a more complex arrangement, micro-controller 310 may be responsive to the number of actuations of switch 210, the timing of the actuations of switch 210 and/or the duration of the actuations of switch 210, whereby a large number of operating states may be programmed and/or provided. Programming of micro-controller 310 may include changing the manner in which micro-controller responds to certain actuations of switch 210 so that operation of light 10 as an illumination source can be changed by a user to suit a particular need or desire.

Examples of other electronic circuits suitable for being utilized in light 10 are described in U.S. patent application Ser. No. 13/195,306 entitled "PORTABLE LIGHT HAVING A ROTATABLE CYLINDRICAL HEAD" filed Aug. 1, 2011, now U.S. Pat. No. 8,511,847, and in U.S. patent application Ser. No. 14/103,438 entitled "PORTABLE LIGHT CHARGEABLE FROM DIFFERENT SOURCES" filed Dec. 11, 2013, each of which is hereby incorporated herein by reference in its entirety.

In a typical embodiment of a portable light 10, light body 20, housing 22 and end cap 60, light head 40 and USB cover 70 are preferably a molded plastic, e.g., a polycarbonate, a polyester, a polycarbonate and polyester blend, nylon, an ABS plastic, a polysulfone, or other suitable plastic material. USB end cap 80 including tether 86, 88 is and end cap 60 is over-molded with a flexible elastomer, e.g., a nitrile rubber, an EPDM elastomer, a thermoplastic elastomer (TPE), silicone rubber, or other suitable flexible and/or stretchable plastic. Stalk 30 preferably is a helically wound metal or plastic strip to provide a hollow tube, e.g., a helically wound steel, spring steel, graphene, beryllium copper, or other steel, or other suitable material, but could be a corrugated hollow metal or plastic tube that is bendable and/or shapable into different configurations. Clip 50 is preferably of a metal, e.g., a steel, spring steel, brass, beryllium copper or other suitable metal, but may be a suitable plastic or other non-metallic material. Fasteners 59 may be threaded fasteners that engage surface mount fasteners and standoffs 202, e.g., as are available as PEM® fasteners from Penn Engineering & Manufacturing Corp. located in Danboro, Pa.

In one sample embodiment, light body 20 has a length of about 3 inches (about 7.6 cm) including the about 0.75 inch long (about 1.9 cm) USB cap 70 in place thereon, a width of about 1.2 inches (about 3 cm) and a thickness of about 0.35 inch (about 0.9 cm). Stalk 30 is about 2.4 inches (about 6.1 cm) long and light head 40 is about 0.9 inch (about 2.3 cm) long by about 0.6-0.7 inch (about 1.5-1.8 cm) across. Battery 150 is a lithium polymer rechargeable battery producing about 3.7 volts and is about 1.6 inches (about 4 cm) long by about 0.7 inch (about 1.8 cm) across and by about 0.2 inch (about 0.5 cm) thick.

A portable light 10 may comprise: a molded light housing 20, 22 having a cavity configured for receiving a source of electrical power 150 and an electronic circuit board 200; the molded light housing 20, 22 including a tray 24 for a USB connector 220 integrally molded therewith; a light source 400 supported by the molded light housing 20, 22 for providing light when energized; an electrical switch 64, 210 supported by the molded light housing 20, 22 and actuatable for selectively energizing the light source 400 when a source of electrical power 150 is disposed in the cavity of the molded light housing 20, 22; and a circuit board 200 to which the light source 400 and the electrical switch 64, 210 are connected, wherein the circuit board 200 is configured to provide electrical contacts 224 of a USB connector 220 that are disposed in the tray 24 of the molded light housing 20, 22 to define a USB connector 220 when the electronic circuit board 200 is disposed in the cavity of the molded light housing 20, 22, whereby the tray 24 and the electrical contacts 224 cooperate to provide a USB connector 220 on the molded light housing 20, 22. The molded light housing 20, 22 may have first and second opposing broad surfaces, first and second sides and first and second ends; and wherein the tray 24 may be at one of the ends or sides thereof; or wherein the tray 24 may extend from one of the ends or sides thereof. The circuit board 200 may have a first part that is disposed in the cavity adjacent to one of the broad surfaces of the molded light housing 20, 22 and may have a rectangular extension 222 extending from the first part thereof and disposed in the tray 24, wherein the electrical contacts 224 are on the rectangular extension 222 thereof that is disposed in the tray 24. The light source 400 may include: a light emitting diode for emitting substantially white light; or a light emitting diode for emitting non-white light; or a first light emitting diode for emitting substantially white light and a second a light emitting diode for emitting non-white light. The portable light 10 may further comprise a flexible stalk 30 extending from the molded light housing 20, 22, wherein the light source 400 is supported at an end of the flexible stalk 30 that is distal from the molded light housing 20, 22. The portable light 10 may further comprise a rechargeable source of electrical power 150 disposed in the cavity of the molded light housing 20, 22, and wherein the light source 400 may include: a light emitting diode operable for emitting illumination light and operable in a different state for providing an indication of the charging of the rechargeable source of electrical power 150. The light source 400 may include: a first light emitting diode 410,430 operable in an operating state for emitting illumination light; and a second light emitting diode 410,430 operable in a first operating state for emitting illumination light and operable in a different operating state for providing an indication of charging of the rechargeable source of electrical power 150.

A portable light 10 housing may comprise: a molded housing having a cavity for receiving a source of electrical power 150 and an electronic circuit board 200; the molded light housing 20, 22 including a tray 24 for a USB connector 220 integrally molded therewith; a circuit board 200 configured to provide electrical contacts 224 of a USB connector 220 that are disposed in the tray 24 of the molded light housing 20, 22 to define a USB connector 220 when the circuit board 200 is disposed in the cavity of the molded housing, whereby the tray 24 and the electrical contacts 224 cooperate to provide a USB connector 220 on the molded light housing 20, 22. The molded housing 20, 22 may have first and second opposing broad surfaces, first and second sides and first and second ends; and the tray 24 may be at one of the ends or sides thereof; or the tray 24 may extend from one of the ends or sides thereof. The circuit board 200 may have a first part that is disposed in the cavity adjacent to one of the broad surfaces of the molded housing 20, 22 and may have a rectangular extension 222 extending from the first part of the circuit board 200 and disposed in the tray 24, wherein the electrical contacts 224 are on the rectangular extension 222 that is disposed in the tray 24. The portable light 10 housing may further comprise: a light source 400 supported by the molded housing 20, 22 for providing light when energized; an electrical switch 64, 210 supported by the molded housing 20, 22 and actuatable for selectively energizing the light source 400 when a source of electrical power 150 is disposed in the cavity of the molded housing 20, 22. The light source 400 may include: a light emitting diode 410,430 for emitting substantially white light; or a light emitting diode 410,430 for emitting non-white light; or a first light emitting diode 410,430 for emitting substantially white light and a second a light emitting diode 410,430 for emitting non-white light. The portable light 10 housing may further comprise a flexible stalk 30 extending from the molded housing 20, 22, wherein the light source 400 is supported at an end of the flexible stalk 30 that is distal from the molded housing 20, 22. The portable light 10 housing may further comprise a rechargeable source of electrical power 150 disposed in the cavity of the molded housing 20, 22, wherein the light source 400 may include: a light emitting diode 410,430 is operable for emitting illumination light and operable in a different state for providing an indication of the charging of the rechargeable source of electrical power 150. The light source 400 may include: a first light emitting diode 410,430 operable in an operating state for emitting illumination light; and a second light emitting diode 410,430 operable in a first operating state for emitting illumination light and operable in a different operating state for providing an indication of charging of the rechargeable source of electrical power 150.

A portable light 10 may comprise: a light housing 20, 22 having a cavity for receiving a rechargeable source of electrical power 150; a light source 400 supported by the light housing 20, 22 for providing light when energized; an electrical switch 64, 210 supported by the light housing 20, 22 and actuatable for selectively energizing the light source 400 when a source of electrical power 150 is disposed in the cavity of the light housing 20, 22; a rechargeable source of electrical power 150 disposed in the cavity of the light housing 20, 22; a control circuit 300 disposed in the light housing 20, 22, wherein the control circuit 300 is coupled to the light source 400, the electrical switch 64, 210 and the rechargeable source of electrical power 150 for selectively energizing the light source 400 for providing light, wherein the control circuit 300 is configured for coupling charging power to the rechargeable source of electrical power 150; and an electrical connector 220 for receiving charging power from a source external to the portable light 10, wherein the light source 400 may include: a first light emitting diode 410,430 operable by the control circuit 300 in a first operating state for emitting illumination light and operable by the control circuit 300 in a different operating state for providing an indication of charging of the rechargeable source of electrical power 150. The different operating state of the first light emitting diode 410,430 may include a flashing state or a blinking state when the rechargeable source of electrical power 150 is receiving charging power via the electrical connector. The portable light 10 of claim 1 wherein the light source 400 may include: a second light emitting diode 410,430 operable by the control circuit 300 for emitting illumination light; and wherein the illumination light provided by the second light emitting diode 410,430: is brighter than is the illumination light provided by the first light emitting diode 410,430; or is of a different color than is the illumination light provided by the first light emitting diode 410,430; or is brighter and is of a different color than is the illumination light provided by the first light emitting diode 410,430. The electrical connector 220 may comprise: a USB connector 220 supported by the light housing 20, 22 and coupled to the control circuit 300, the USB connector 220 for receiving charging current from a source external to the portable light 10. The portable light 10 may further comprise: a USB connector tray 24 extending from the light housing 20, 22; and a circuit board 200 disposed in the light housing 20, 22, supporting the control circuit 300 and to which the light source 400 and the electrical switch 64, 210 are connected, wherein the circuit board 200 is configured to provide electrical contacts 224 of a USB connector 220 that are disposed in the USB connector tray 24 to define the USB connector 220 when the circuit board 200 is disposed in the cavity of the light housing 20, 22, whereby the USB connector tray 24 of the light housing 20, 22 and the USB electrical contacts 224 of the circuit board 200 cooperate to provide the USB connector 220.

A rechargeable portable light 10 may comprise: a generally rectangular light body 20 having a generally rectangular cavity therein; a generally rectangular rechargeable source of electrical power 150 disposable in the cavity of the light body 20; a light head 40 supported by the light body 20, the light head 40 including a light source 400 for producing light, wherein the light head 40 may be movable relative to the light body 20 for directing light in different directions; an electrical switch 64, 210, for selectively actuating the light source 400; an electronic circuit board 200 disposed between the rechargeable source of electrical power 150 and a wall of the light body 20, the electronic circuit 300 being electrically connected to the rechargeable source of electrical power 150 and to the light source 400 and including an electronic circuit 300 for controlling operation of the light source 400 responsive to the electrical switch 64, 210; and a male USB connector 220 extending from the light body 20 for connecting to a female USB connector of a source of charging power, the male USB connector 220 connecting to the electronic circuit 300 and to the rechargeable source of electrical power 150 for charging the rechargeable source of electrical power 150. The light head 40 may further comprise: a flexible bendable stalk 30 extending from the light body 20 and having the light source 400 at an end thereof distal from the light body 20; or a flexible bendable stalk 30 extending from the light body 20 and having the light source 400 at an end thereof distal from the light body 20, wherein the flexible bendable stalk 30 may be bendable at least about 180° in any direction relative to a straight position of the flexible bendable stalk 30; or a flexible bendable stalk 30 extending substantially perpendicularly from the light body 20 and having the light source 400 at an end thereof distal from the light body 20; or a flexible bendable stalk 30 extending substantially perpendicularly from the light body 20 and having the light source 400 at an end thereof distal from the light body 20, wherein the flexible bendable stalk 30 may be bendable at least about 180° in any direction relative to a straight position of the flexible bendable stalk 30. The light head 40 may further comprise: a flexible bendable stalk 30 extending from the light body 20 and having the light source 400 at an end thereof distal from the light body 20 and a seal between the light body 20 and the flexible bendable stalk 30; or a flexible bendable stalk 30 extending substantially perpendicularly from the light body 20 and having the light source 400 at an end thereof distal from the light body 20 and a seal between the light body 20 and the flexible bendable stalk 30; or a flexible bendable stalk 30 extending substantially perpendicularly from a side of the light body 20 and having the light source 400 at an end thereof distal from the light body 20 and a seal between the light body 20 and the flexible bendable stalk 30. The rechargeable source of electrical power 150 may include: a rechargeable battery 150; or a rechargeable lithium battery 150. The rechargeable portable light 10 may further comprise: a connector cap 70 for covering the male USB connector 220; or a connector cap 70 for covering the male USB connector 220 wherein the connector cap 70 may be attached to the light body 20 by a tether. The rechargeable portable light 10 may further comprise: a clip 50 attached to the light body 20 for attaching the rechargeable portable light 10 to a person and/or object; or a clip 50 attached to the light body 20 for attaching the rechargeable portable light 10 to a person and/or object, the clip 50 having a keyhole shaped opening therein. The rechargeable portable light 10 of claim 1 wherein: the electronic circuit board 200 may be a single circuit board 200 including the switch 210 and electrical contacts of the male USB connector 220; or the generally rectangular light body 20 may include an integrally molded male USB connector tray 24; or the electronic circuit board 200 may be a single circuit board 200 including the switch 210 and electrical contacts of the male USB connector 220 and the generally rectangular light body 20 may include an integrally molded male USB connector tray 24.

A rechargeable portable light 10 may comprise: a light body 20; a rechargeable source of electrical power 150 disposable in the light body 20; a light head 40 supported by the light body 20, the light head 40 including a light source 400 for producing light, wherein the light head 40 may be movable relative to the light body 20 for directing light in different directions; a switch 64, 210, for selectively actuating the light source 400; an electronic circuit 300 disposed in the light body 20, the electronic circuit 300 being electrically connected to the rechargeable source of electrical power 150 and to the light source 400 for controlling operation of the light source 400 responsive to the electrical switch 64, 210; and a male USB connector 220 on the light body 20 for connecting to a female USB connector of a source of charging power, the male USB connector 220 connecting to the electronic circuit 300 and to the rechargeable source of electrical power 150 for charging the rechargeable source of electrical power 150. The light head 40 may further comprise: a flexible bendable stalk 30 extending from the light body 20 and having the light source 400 at an end thereof distal from the light body 20; or a flexible bendable stalk 30 extending from the light body 20 and having the light source 400 at an end thereof distal from the light body 20, wherein the flexible bendable stalk 30 may be bendable at least about 180° in any direction relative to a straight position of the flexible bendable stalk 30; or a flexible bendable stalk 30 extending substantially perpendicularly from the light body 20 and having the light source 400 at an end thereof distal from the light body 20; or a flexible bendable stalk 30 extending substantially perpendicularly from the light body 20 and having the light source 400 at an end thereof distal from the light body 20, wherein the flexible bendable stalk 30 may be bendable at least about 180° in any direction relative to a straight position of the flexible bendable stalk 30. The light head 40 may further comprise: a flexible bendable stalk 30 extending from the light body 20 and having the light source 400 at an end thereof distal from the light body 20 and a seal between the light body 20 and the flexible bendable stalk 30; or a flexible bendable stalk 30 extending substantially perpendicularly from the light body 20 and having the light source 400 at an end thereof distal from the light body 20 and a seal between the light body 20 and the flexible bendable stalk 30; or a flexible bendable stalk 30 extending substantially perpendicularly from a side of the light body 20 and having the light source 400 at an end thereof distal from the light body 20 and a seal between the light body 20 and the flexible bendable stalk 30. The rechargeable source of electrical power 150 may include: a rechargeable battery 150; or a rechargeable lithium battery 150. The rechargeable portable light 10 may further comprise: a connector cap 70 for covering the male USB connector 220; or a connector cap 70 for covering the male USB connector 220 wherein the connector cap 70 may be attached to the light body 20 by a tether. The rechargeable portable light 10 of claim 1 may further comprise: a clip 50 attached to the light body 20 for attaching the rechargeable portable light 10 to a person and/or object; or a clip 50 attached to the light body 20 for attaching the rechargeable portable light 10 to a person and/or object, the clip 50 having a keyhole shaped opening therein. The rechargeable portable light 10 wherein: the electronic circuit 300 may include a single circuit board 200 including the switch 210 and electrical contacts of the male USB connector 220; or the light body 20 may include an integrally molded male USB connector tray 24; or the electronic circuit 300 may include a single circuit board 200 including the switch 210 and electrical contacts of the male USB connector 220 and the light body 20 may include an integrally molded male USB connector tray 24.

A rechargeable portable light 10 may comprise: a light body 20; a rechargeable source of electrical power 150 disposable in the light body 20; a flexible bendable stalk 30 extending from the light body 20 and supported thereby; a light head 40 supported at a distal end of the flexible bendable stalk 30, the light head 40 including a light source 400 for producing light, wherein the light head 40 may be movable relative to the light body 20 for directing light in different directions; a switch 64, 210, for selectively actuating the light source 400; an electronic circuit 300 disposed in the light body 20, the electronic circuit 300 being electrically connected to the rechargeable source of electrical power 150 and to the light source 400 for controlling operation of the light source 400 responsive to the electrical switch 64, 210; and a male USB connector 220 on the light body 20 for connecting to a female USB connector of a source of charging power, the male USB connector 220 connecting to the electronic circuit 300 and to the rechargeable source of electrical power 150 for charging the rechargeable source of electrical power 150. The flexible bendable stalk 30: may be bendable at least about 180° in any direction relative to a straight position of the flexible bendable stalk 30; or may extend substantially perpendicularly from the light body 20 and may be bendable at least about 180° in any direction relative to a straight position of the flexible bendable stalk 30. The flexible bendable stalk 30 may further comprise a seal between the light body 20 and the flexible bendable stalk 30. The rechargeable source of electrical power 150 may include: a rechargeable battery 150; or a rechargeable lithium battery 150. The rechargeable portable light 10 may further comprise: a connector cap 70 for covering the male USB connector 220; or a connector cap 70 for covering the male USB connector 220 wherein the connector cap 70 may be attached to the light body 20 by a tether. The rechargeable portable light 10 may further comprise: a clip 50 attached to the light body 20 for attaching the rechargeable portable light 10 to a person and/or object; or a clip 50 attached to the light body 20 for attaching the rechargeable portable light 10 to a person and/or object, the clip 50 having a keyhole shaped opening therein. The electronic circuit 300 may include a single circuit board 200 including the switch 210 and electrical contacts of the male USB connector 220; or the light body 20 may include an integrally molded male USB connector tray 24; or the electronic circuit 300 may include a single circuit board 200 including the switch 210 and electrical contacts of the male USB connector 220 and the light body 20 may include an integrally molded male USB connector tray 24.

A rechargeable portable light 10 may comprise: a light body 20; a rechargeable source of electrical power 150 disposable in the light body 20; a light head 40 supported by the light body 20 and including a light source 400 for producing light; a switch 64, 210, for selectively actuating the light source 400 from the rechargeable source of electrical power 150; a male USB connector 220 on the light body 20 for connecting to a female USB connector of a source of charging power for receiving electrical power 150 therefrom; and an electronic circuit 300 disposed in the light body 20, the electronic circuit 300 being electrically connected to the rechargeable source of electrical power 150 and to the light source 400 for controlling operation of the light source 400 responsive to the electrical switch 64, 210, and being electrically connected to the male USB connector 220 for coupling electrical power 150 received at the USB connector 220 for charging the rechargeable source of electrical power 150. The light head 40 may be movable relative to the light body 20 for directing light in different directions; or the light head 40 may include a flexible bendable stalk 30 extending from the light body 20 and having the light source 400 at an end thereof distal the light body 20, wherein the flexible bendable stalk 30 may be bendable at least about 180° in any direction relative to a straight position of the flexible bendable stalk 30; or the light head 40 may include a flexible bendable stalk 30 extending substantially from a side of the light body 20 and having the light source 400 at an end thereof distal the light body 20, wherein the flexible bendable stalk 30 may be bendable at least about 180° in any direction relative to a straight position of the flexible bendable stalk 30. The light head 40 may further comprise: a flexible bendable stalk 30 extending from the light body 20 and having the light source 400 at an end thereof distal from the light body 20 and a seal between the light body 20 and the flexible bendable stalk 30; or a flexible bendable stalk 30 extending substantially perpendicularly from the light body 20 and having the light source 400 at an end thereof distal from the light body 20 and a seal between the light body 20 and the flexible bendable stalk 30; or a flexible bendable stalk 30 extending substantially perpendicularly from a side of the light body 20 and having the light source 400 at an end thereof distal from the light body 20 and a seal between the light body 20 and the flexible bendable stalk 30. The rechargeable source of electrical power 150 may include: a rechargeable battery 150; or a rechargeable lithium battery 150. The rechargeable portable light 10 may further comprise: a connector cap 70 for covering the male USB connector 220; or a connector cap 70 for covering the male USB connector 220 wherein the connector cap 70 may be attached to the light body 20 by a tether. The rechargeable portable light 10 may further comprise: a clip 50 attached to the light body 20 for attaching the rechargeable portable light 10 to a person and/or object; or a clip 50 attached to the light body 20 for attaching the rechargeable portable light 10 to a person and/or object, the clip 50 having a keyhole shaped opening therein. The electronic circuit 300 may include a single circuit board 200 including the switch 210 and electrical contacts of the male USB connector 220; or the light body 20 may include an integrally molded male USB connector tray 24; or the electronic circuit 300 may include a single circuit board 200 including the switch 210 and electrical contacts of the male USB connector 220 and the light body 20 may include an integrally molded male USB connector tray 24.

A portable light 10 may comprise: a generally rectangular light body 20 having first and second opposing broad generally rectangular surfaces, having first and second generally rectangular sides and having first and second generally rectangular ends; a source of electrical power 150 disposed in the generally rectangular light body 20; a flexible bendable stalk 30 extending generally perpendicularly from the first generally rectangular side of the generally rectangular light body 20 and supported thereby; a light head 40 supported at a distal end of the flexible bendable stalk 30, the light head 40 including a light source 400 for producing light, wherein the light head 40 may be movable relative to the generally rectangular light body 20 for directing light in different directions; a switch actuator 64 on the first generally rectangular end of the generally rectangular light body 20 for selectively actuating the light source 400; and an electronic circuit 300 disposed in the light body 20, the electronic circuit 300 being electrically connected to the source of electrical power 150 and to the light source 400 for controlling operation of the light source 400 responsive to the electrical switch 64, 210. The flexible bendable stalk 30 may be bendable at least about 180° in any direction relative to a straight position of the flexible bendable stalk 30. The flexible bendable stalk 30 may further comprise a seal between the generally rectangular light body 20 and the flexible bendable stalk 30. The portable light 10 of claim 1 wherein the source of electrical power 150 may include a rechargeable source of electrical power 150, the portable light 10 may further comprise: a male USB connector 220 on the light body 20 for connecting to a female USB connector 220 of a source of charging power, the male USB connector 220 connecting to the electronic circuit 300 and to the rechargeable source of electrical power 150 for charging the rechargeable source of electrical power 150. The rechargeable source of electrical power 150 may include: a rechargeable battery 150; or a rechargeable lithium battery 150. The portable light 10 may further comprise: a connector cap 70 at the second end of the generally rectangular light body 20 for covering the male USB connector 220; or a connector cap 70 at the second end of the generally rectangular light body 20 for covering the male USB connector 220 wherein the connector cap 70 may be attached to the light body 20 by a tether. The portable light 10 may further comprise: a clip 50 attached to the 1 generally rectangular light body 20 for attaching the portable light 10 to a person and/or object; or a clip 50 attached to the generally rectangular light body 20 for attaching the portable light 10 to a person and/or object, the clip 50 having a keyhole shaped opening therein. The clip 50 may be attached to the generally rectangular light body 20 near the first generally rectangular light body 20 end thereof and may extend along one of the generally rectangular broad surfaces thereof. The electronic circuit 300 may include a single circuit board 200 including the switch 210 and electrical contacts of the male USB connector 220; or the generally rectangular light body 20 may include an integrally molded male USB connector tray 24; or the electronic circuit 300 may include a single circuit board 200 including the switch 210 and electrical contacts of the male USB connector 220 and the generally rectangular light body 20 may include an integrally molded male USB connector tray 24.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "front," "rear," "side," "top," "bottom," "forward," "backward," "under" and/or "over," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device, in the present instance, preferably a rechargeable battery. Other rechargeable devices could include fuel cells, super capacitors, solar cells, and the like.

Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH), lithium-ion (Li-Ion) or lithium polymer battery type, of a suitable number of cells and cell capacity for providing a desired operating time for the particular device. Examples may include a three cell Ni—Cd battery typically producing about 3.6 volts, a four cell NiMH battery typically producing about 4.8 volts, a five cell NiMH battery producing about 6 volts, a Li-Ion battery typically producing about 3.5 volts, or a two-cell Li-Ion battery typically producing about 7 volts, or a one or more cell lithium-polymer battery producing about 3.7 volts or a multiple thereof, it being noted that the voltages produced thereby will be higher when approaching full charge and will be lower in discharge, particularly when providing higher current and when reaching a low level of charge, e.g., becoming discharged.

The term DC converter is used herein to refer to any electronic circuit that receives at an input electrical power at one voltage and current level and provides at an output DC electrical power at a different voltage and/or current level. Examples may include a DC-DC converter, an AC-DC converter, a boost converter, a buck converter, a buck-boost converter, a single-ended primary-inductor converter (SEPIC), a series regulating element, a current level regulator, and the like. The input and output thereof may be DC coupled and/or AC coupled, e.g., as by a transformer and/or capacitor. A DC converter may or may not include circuitry for regulating a voltage and/or a current level, e.g., at an output thereof, and may have one or more outputs providing electrical power at different voltage and/or current levels and/or in different forms, e.g., AC or DC.

While the present invention has been described in terms of the foregoing example embodiments, variations within the scope and spirit of the present invention as defined by the claims following will be apparent to those skilled in the art. For example, while male connector 220 is preferably a male USB connector, e.g., a Type A USB connector, any other standard male connector may be employed. Preferably, the male connector mates with a standard type female connector that is in common usage so that rechargeable light 10 can be plugged into a variety of devices having the standard type female connector for being recharged and/or operated by electrical power provided by the variety of devices.

While light 10 is described as having a relatively higher brightness white LED 410 and a relatively lower brightness red LED 420, light 10 may have only a single light source, or my have more than two light sources. In addition, the single and plural light sources may include those that produce, e.g., red, green, blue, yellow, orange, infrared and/or ultraviolet light and combinations thereof. In addition or alternatively, one of more of the LEDs may be operated in a manner to serve as an indicator and/or signaling light, e.g., to indicate a condition associated with light 10, e.g., to indicating the battery is charging or has been charged.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made.

While battery 150 and light body 20 are shown and described as preferably being generally rectangular in shape, either or both may be of any suitable shape, e.g., cylindrical or disk shaped, and stalk 30 may be either longer or shorted in length than illustrated, as may be desired for any particular light configuration.

Each of the U.S. Provisional applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a molded light housing having a cavity configured for receiving a source of electrical power and an electronic circuit board;

said molded light housing including a tray for a USB connector integrally molded therewith;

a light source supported by said molded light housing for providing light when energized;

an electrical switch supported by said molded light housing and actuatable for selectively energizing said light source when a source of electrical power is disposed in the cavity of said molded light housing; and a circuit board to which said light source and said electrical switch are connected, wherein said circuit board is configured to provide electrical contacts of a USB connector that are disposed in the tray of said molded light housing to define a USB connector when said electronic circuit board is disposed in the cavity of said molded light housing, whereby the tray and the electrical contacts cooperate to provide a USB connector on said molded light housing.

2. The portable light of claim 1 wherein said molded light housing has first and second opposing broad surfaces, first and second sides and first and second ends; and wherein the tray is at one of the ends or sides thereof; or wherein the tray extends from one of the ends or sides thereof.

3. The portable light of claim 2 wherein said circuit board has a first part that is disposed in the cavity adjacent to one of the broad surfaces of said molded light housing and has a rectangular extension extending from the first part thereof and disposed in the tray, wherein the electrical contacts are on the rectangular extension thereof that is disposed in the tray.

4. The portable light of claim 1 wherein said light source includes:

a light emitting diode for emitting substantially white light; or a light emitting diode for emitting non-white light; or a first light emitting diode for emitting substantially white light and a second a light emitting diode for emitting non-white light.

5. The portable light of claim 1 further comprising a flexible stalk extending from said molded light housing, wherein said light source is supported at an end of said flexible stalk that is distal from said molded light housing.

6. The portable light of claim 1 further comprising a rechargeable source of electrical power disposed in the cavity of said molded light housing, and wherein said light source includes:

a light emitting diode operable for emitting illumination light and operable in a different state for providing an indication of the charging of said rechargeable source of electrical power.

7. The portable light of claim 1 wherein said light source includes:

a first light emitting diode operable in an operating state for emitting illumination light; and a second light emitting diode operable in a first operating state for emitting illumination light and operable in a different operating state for providing an indication of charging of said rechargeable source of electrical power.

8. A portable light housing comprising:

a molded housing having a cavity for receiving a source of electrical power and an electronic circuit board;

said molded housing including a tray for a USB connector integrally molded therewith;

a circuit board configured to provide electrical contacts of a USB connector that are disposed in the tray of said molded housing to define a USB connector when said circuit board is disposed in the cavity of said molded housing, whereby the tray and the electrical contacts cooperate to provide a USB connector on said molded housing.

9. The portable light housing of claim 8 wherein said molded housing has first and second opposing broad surfaces, first and second sides and first and second ends; and wherein the tray is at one of the ends or sides thereof; or wherein the tray extends from one of the ends or sides thereof.

10. The portable light housing of claim 8 wherein said circuit board has a first part that is disposed in the cavity adjacent to one of the broad surfaces of said molded housing and has a rectangular extension extending from the first part of said circuit board and disposed in the tray, wherein the electrical contacts are on the rectangular extension that is disposed in the tray.

11. The portable light housing of claim 8 further comprising:

a light source supported by said molded housing for providing light when energized;

an electrical switch supported by said molded housing and actuatable for selectively energizing said light source when a source of electrical power is disposed in the cavity of said molded housing.

12. The portable light housing of claim 11 wherein the light source includes:

a light emitting diode for emitting substantially white light; or a light emitting diode for emitting non-white light; or a first light emitting diode for emitting substantially white light and a second a light emitting diode for emitting non-white light.

13. The portable light housing of claim 11 further comprising a flexible stalk extending from said molded housing, wherein said light source is supported at an end of said flexible stalk that is distal from said molded housing.

14. The portable light housing of claim 11 further comprising a rechargeable source of electrical power disposed in the cavity of said molded housing, wherein said light source includes:

a light emitting diode is operable for emitting illumination light and operable in a different state for providing an indication of the charging of said rechargeable source of electrical power.

15. The portable light housing of claim 11 wherein said light source includes:

a first light emitting diode operable in an operating state for emitting illumination light; and a second light emitting diode operable in a first operating state for emitting illumination light and operable in a different operating state for providing an indication of charging of said rechargeable source of electrical power.

16. A portable light comprising:

a light housing having a cavity for receiving a rechargeable source of electrical power;

a light source supported by said light housing for providing light when energized;

an electrical switch supported by said light housing and actuatable for selectively energizing said light source when a source of electrical power is disposed in the cavity of said light housing;

a rechargeable source of electrical power disposed in the cavity of said light housing;

a control circuit disposed in said light housing, wherein said control circuit is coupled to said light source, said electrical switch and said rechargeable source of electrical power for selectively energizing said light source for providing light, wherein said control circuit is configured for coupling charging power to said rechargeable source of electrical power; and an electrical connector for receiving charging power from a source external to said portable light, wherein said light source includes:

a first light emitting diode operable by said control circuit in a first operating state for emitting illumination light and operable by said control circuit in a different operating state for providing an indication of charging of said rechargeable source of electrical power.

17. The portable light of claim 16 wherein the different operating state of said first light emitting diode includes a flashing state or a blinking state when said rechargeable source of electrical power is receiving charging power via said electrical connector.

18. The portable light of claim 16 wherein said light source includes:

a second light emitting diode operable by said control circuit for emitting illumination light; and wherein the illumination light provided by said second light emitting diode:

is brighter than is the illumination light provided by said first light emitting diode; or is of a different color than is the illumination light provided by said first light emitting diode; or is brighter and is of a different color than is the illumination light provided by said first light emitting diode.

19. The portable light of claim 16 wherein said electrical connector comprises:

a USB connector supported by said light housing and coupled to said control circuit, said USB connector for receiving charging current from a source external to said portable light.

20. The portable light of claim 19 further comprising:

a USB connector tray extending from said light housing; and a circuit board disposed in said light housing, supporting said control circuit and to which said light source and said electrical switch are connected, wherein said circuit board is configured to provide electrical contacts of a USB connector that are disposed in said USB connector tray to define said USB connector when said circuit board is disposed in the cavity of said light housing, whereby said USB connector tray of said light housing and the USB electrical contacts of said circuit board cooperate to provide said USB connector.

* * * * *